US011591871B1

(12) United States Patent
Randall et al.

(10) Patent No.: US 11,591,871 B1
(45) Date of Patent: Feb. 28, 2023

(54) ELECTRICALLY-ACTUATED RESETTABLE DOWNHOLE ANCHOR AND/OR PACKER, AND METHOD OF SETTING, RELEASING, AND RESETTING

(71) Applicant: Coiled Tubing Specialties, LLC, Tulsa, OK (US)

(72) Inventors: Bruce L. Randall, Tulsa, OK (US); David P. Brisco, Duncan, OK (US); Bradford G. Randall, Tulsa, OK (US)

(73) Assignee: Coiled Tubing Specialties, LLC, Tulsa, OK (US)

( * ) Notice: Subject to any disclaimer, the term of this patent is extended or adjusted under 35 U.S.C. 154(b) by 214 days.

(21) Appl. No.: 17/005,591

(22) Filed: Aug. 28, 2020

(51) Int. Cl.

| | |
|---|---|
| ***E21B 23/06*** | (2006.01) |
| ***E21B 33/129*** | (2006.01) |
| *E21B 41/00* | (2006.01) |
| *E21B 47/07* | (2012.01) |
| *E21B 47/135* | (2012.01) |
| *E21B 43/267* | (2006.01) |

(52) U.S. Cl.
CPC ..... *E21B 23/06* (2013.01); *E21B 33/1293* (2013.01); *E21B 41/0085* (2013.01); *E21B 43/267* (2013.01); *E21B 47/07* (2020.05); *E21B 47/135* (2020.05)

(58) Field of Classification Search
CPC .. E21B 23/06; E21B 33/1293; E21B 41/0085; E21B 47/07; E21B 47/135
See application file for complete search history.

(56) References Cited

U.S. PATENT DOCUMENTS 4,256,179 A 3/1981 Shillander
5,291,975 A 3/1994 Johnson et al.
(Continued)

FOREIGN PATENT DOCUMENTS

GB 2260352 A * 4/1993 ..... E21B 17/06
WO WO-2016060658 A1 * 4/2016 ..... E21B 23/06
WO WO-2021262009 A1 * 12/2021

OTHER PUBLICATIONS

L.M. Ford, Waterjet Assisted Mining Tools What Type Assistance and What Type Mining Machine?, Energy Citations Database (1983) Abstract Only.

(Continued)

*Primary Examiner* — Daniel P Stephenson
(74) *Attorney, Agent, or Firm* — Dennis D. Brown; Brown Patent Law, P.L.L.C.

(57) ABSTRACT

An electric motor-actuated packer and/or anchor (EMAP/A) apparatus and method for use in downhole operations. The apparatus includes a packer subassembly and/or a slip subassembly and can be: set in a packer and anchor mode; set in an anchor-only mode without energizing the packer elements; repeatedly set and unset without run-in string manipulation; run in a multiple, or redundant, configuration within a given tool string, with each EMAP/A apparatus capable of being set/unset independently of the others; and combined within a tool string in a straddle packer configuration, with inverted and non-inverted EMAP/As providing the ability to isolate an interval of interest from both above and below the interval. Among other uses, the apparatus and method are well suited for application in a single-trip, e-coil conveyed completion system, and particularly one providing for radial hydraulic jetting.

42 Claims, 6 Drawing Sheets

Packer Elements Expanded Inside Casing

(56) References Cited

U.S. PATENT DOCUMENTS

| | | | | |
|---|---|---|---|---|
| 5,413,184 | A | 5/1995 | Landers | |
| 5,853,056 | A | 12/1998 | Landers | |
| 6,125,949 | A | 10/2000 | Landers | |
| 6,263,984 | B1 | 7/2001 | Buckman, Sr. | |
| 6,283,230 | B1 | 9/2001 | Peters | |
| 6,378,629 | B1 | 4/2002 | Baird | |
| 6,412,578 | B1 | 7/2002 | Baird | |
| 6,419,020 | B1 | 7/2002 | Spingath | |
| 6,530,439 | B2 | 3/2003 | Mazorow | |
| 6,550,553 | B2 | 4/2003 | Baird | |
| 6,578,636 | B2 | 6/2003 | Mazorow et al. | |
| 6,668,948 | B2 | 12/2003 | Buckman, Sr. et al. | |
| 6,889,781 | B2 | 5/2005 | Mazorow | |
| 6,915,853 | B2 | 7/2005 | Bakke et al. | |
| 6,964,303 | B2 | 11/2005 | Mazorow et al. | |
| 6,971,457 | B2 | 12/2005 | Baird | |
| 7,114,583 | B2 | 10/2006 | Chrisman | |
| 7,168,491 | B2 | 1/2007 | Malone et al. | |
| 7,350,577 | B2 | 4/2008 | Watson | |
| 7,357,182 | B2 | 4/2008 | Hunt et al. | |
| 7,422,059 | B2 | 9/2008 | Jelsma | |
| 7,441,595 | B2 | 10/2008 | Jelsma | |
| 7,445,127 | B2 | 11/2008 | Schick | |
| 7,540,327 | B2 | 6/2009 | Billingham | |
| 7,669,672 | B2 | 3/2010 | Brunet et al. | |
| 7,686,101 | B2 | 3/2010 | Belew et al. | |
| 7,699,107 | B2 | 4/2010 | Butler et al. | |
| 7,886,834 | B2 | 2/2011 | Spencer et al. | |
| 7,971,658 | B2 | 7/2011 | Buckman, Sr. | |
| 8,074,744 | B2 | 12/2011 | Watson et al. | |
| 8,196,680 | B2 | 6/2012 | Buckman, Sr. et al. | |
| 8,267,198 | B2 | 9/2012 | Buckman, Sr. et al. | |
| 8,267,199 | B2 | 9/2012 | Buckman, Sr. et al. | |
| 8,327,746 | B2 | 12/2012 | Behrmann et al. | |
| 8,752,651 | B2 | 6/2014 | Randall et al. | |
| 8,833,444 | B2 | 9/2014 | McAfee et al. | |
| 8,991,522 | B2 | 3/2015 | Randall et al. | |
| 9,267,338 | B1 | 2/2016 | LeBlanc et al. | |
| 9,976,351 | B2 | 5/2018 | Randall | |
| 10,174,573 | B2 | 1/2019 | Bakke et al. | |
| 10,233,493 | B2 | 3/2019 | He et al. | |
| 10,309,205 | B2 | 6/2019 | Randall | |
| 11,072,992 | B1 * | 7/2021 | Milne | E21B 33/128 |
| 2005/0173123 | A1 | 8/2005 | Lund et al. | |
| 2008/0073077 | A1 | 3/2008 | Tunc et al. | |
| 2008/0179061 | A1 | 7/2008 | McAfee | |
| 2009/0091202 | A1 | 4/2009 | Parmeter et al. | |
| 2009/0107678 | A1 | 4/2009 | Buckman, Sr. | |
| 2010/0243266 | A1 | 9/2010 | Soby et al. | |
| 2011/0203847 | A1 | 8/2011 | Randall et al. | |
| 2011/0290561 | A1 | 12/2011 | Randall et al. | |
| 2013/0284516 | A1 | 10/2013 | Prill et al. | |
| 2016/0115753 | A1 * | 4/2016 | Frazier | E21B 43/1185 166/66.4 |
| 2019/0360304 | A1 * | 11/2019 | Alley | E21B 34/10 |

OTHER PUBLICATIONS

J.J. Koelee, A Comparison of Water Jet Abrasive Jet and Rotary Diamond Drilling in Hard Rock; Tempress Technologies, Oil and Gas Journal, vol. 96 (1999).

A.W. Momber, et al., An Energy Balance of High Speed Abrasive Water Jet Erosion; Institution of Mechnical Enineers, vol. 213 Part J; pp. 463-473 (Dec. 1998).

H. Orbanic, et al., An Instrument for Measuring Abrasive WaterJet Diameter; International J. of Machine Tools & Manufacture, #49; pp. 843-849 (May 2009).

D.A. Summers, et al., Abrasive Jet Drilling: A New Technology; 30th U.S. Symposium on Rock Mechanics, Morgantown, West Virginia (Jun. 1989).

Michael J. Mayerhofer, SRV Proves Key in Shales for Correlating Stimulation and Well Performance; Oil & Gas Reporter, pp. 81-89 (Dec. 2010).

Buckman Jet Drilling presentation, ICoTA Lunch, Houston, Texas (Aug. 2013).

W. Dickinson, et al., Coiled-Tubing Radials Placed by Water-Jet Drilling, SPE Paper No. 26,348, Houston, Texas (Oct. 1993).

D.A. Summers et al., Comparison of Methods Available for the Determination of Surface Energy, 12th Symposium or Rock Mechanics, Univ of Missouri-Rolla (Nov. 1970).

International Search Report and Written Opinion for PCT/US2016/015771,Dated Jun. 3, 2016.

PCT International Application PCT/US2018/056987, Publication No. WO 2019/083922, Published May 9, 2019.

S.D. Joshi, A Review of Horizontal Well and Drainhole Technology, SPE Paper No. 16,868; presented at the 62nd Annual Technical Conference (Sep. 1987).

J.H. Olsen, Abrasive Jet Mechanics, Te Fabricator Magazine (Mar. 2005 www.omax.com/images/files/abrasjvejet%20mechanics.pdf.

M. Kojic, et al., Analysis of the influence of Fluid Flow on Plasticity of Porous Rock Under an Axially Symmetric Punch, SPE Paper No. 4243 (Jun. 1974).

D.A. Summers, et al., Can Nozzle Design Be Effectively Improved for Drilling Purposes, Energy Technology Conference, Houston, Texas (Nov. 1978).

*Carl Landers and Landers Horizontal Drill Inc* v *Sideways LLC*, United States Court of Appeals for the Federal Circuit, 04-1510, -1538 (Decided Jul. 27, 2005).

Carrell, et al. Report, Lateral Drilling and Completion Technologies for Shallow-Shelf Carbonates of the Red River and Ratcliffe Formations, Williston Basin (Jul. 1997).

W. Dickinson, et al., Data Acquisition Analysis and Control While Drilling With Horizontal Water Jet Drilling Systems, SPE Paper No. 90-127 (Jun. 1990).

A.W. Momber, Deformation and Fracture of Rocks Due to High Speed Liquicd Impingement, International J. of Fracture, pp. 683-704, Netherlands (Aug. 2044).

G.P. Tziallas, et al., Determination of Rock Strength and Deformability of Intact Rocks, EJGE vol. 14 (2009).

D.A. Summers, et al., Development of a Water Jet Drilling System, 4th International Symposium on Jet Cutting Technology, Canterbury, England (Apr. 1978).

D.A. Summers, Disintegration of Rock by High Pressure Jets, University of Leeds, Department of Applied Meneral Sciences, Ph.D. Dissertation (May 1968).

D. Katz, et al., Evaluation of Mechanical Rock Properties Using a Schmidt Hammer, International J. of Rock Mechanics, pp. 723-728 (2000).

D.A. Summers, Feasibility of Fluid Jet Based Drilling Methods for Drilling Through Unstable Formations, SPE Horizontal Well Technology Conference, Calgary, Alberta (Nov. 2002).

W.C. Maurer, et al., High Pressure Drilling, Journal of Petroleum Technology, pp. 851-859 (Jul. 1973).

W. Dickinson, et al., Horizontal Radial Drilling System, Society of Petroleum Engineers No. 13,949; California Regional Meeting, Bakersfield, California (Mar. 1985).

W.C. Maurer, et al., Hydraulic Jet Drilling, SPE Paper No. 2,434 (1969).

J.L. Pekarek, et al., Hydraulic Jetting: Some Theoretical and Experimental Results, SPE Paper No. 421, pp. 101-112 (Jun. 1963).

R. Kovaceviv, Hydraulic Process Parameters, SMU School of Engineering—Website Publication (accessed in 2012) http://lyfe.smu.edu/.

D.A. Summers, et al., HyperVelocity Impact on Rock, AIME's Eleventh Symposium on Rock Mechanics, Berkely, California; Part VI—Chapter 32 (Jun. 1969).

F.C. Pittman, Investigation of Abrasive Laden Fluid Method for Perforation and Fracture Initiation, SPE Paper No. 1607-G; J. of Petroleum Technology, pp. 489-495 (May 1961).

P. Buset, A Jet Drilling Tool: Cost Effective Lateral Drilling Technology, SPE Paper No. 68,504; SPE/ICoTA Roundtable, Houston, Texas (Mar. 2001).

D.A. Summers, et al., Petroleum Applications of Emerging High Pressure Waterjet Technology, SPE Paper No. 26,347, Houston, Texas (Oct. 1993).

(56) References Cited

OTHER PUBLICATIONS

D.A. Summers, et al., Progress in Rock Drilling, Mechanical Engineering (Dec. 1989).
John H. Olson, Pumping Up the Waterjet Power, pp. 1-5 (Dec. 2007).
D.A. Summers, Recent Advances in the Use of High Pressure Waterjets in Drilling Applications, Advance Mining Technology Workshop, Colorado School of Mines (Oct. 1995).
R. Feenstra, et al., Rock Cutting by Jets a Promising Method of Oil Well Drilling, SPE Paper No. 4,923 (Sep. 1973).
W. Dickinson, et al., Slim Hole Multiple Radials Drilled with Coiled Tubing, SPE Paper No. 23,639; 2nd Latin American Petroleum Engineering Conference, Venzuela (Mar. 1992).
Smith Services, A Business Unit of Smith International, Inc., Smith International Inc. Trackmaster PLUS Wellbore Departure Systems, Houston, Texas (Apr. 2005).
D.A. Summers, The Application of Waterjets in a Stressed Rock Environment, Third Conference on Ground COntrol Problems in the Illinois Coal Basin (Aug. 1990).
P.C. Hagan, et al., The Cuttability of Rock Using a High Pressure Water Jet, School of Mining Engineering, The University of New South Wales (1990).
D.A. Summers, et al., The Effect of Change in Energy and Momentum Levels on the Rock Removal in Indiana Limestone, Symposium on Jet Cutting Technology, England (Apr. 1972).
D.A. Summers, et al., The Effect of Stress on Waterjet Performance, 19th Symposium on Rock Mechanics, Lake Tahoe, Nevada (May 1978).
D.A. Summers, et al., The Penetration of Rock by High Speed Water Jets, Int. J. Rock Meeh. Min. Sci. vol. 6, pp. 249-258 Pergamon Press (1969).
U.S. Hose Corp., U.S. Hose Corporation Engineering Guide No. 350, Technical Specifications for U.S. HOSE's Flexible Hoses, Romeoville, Illinois and Houston, Texas (2006).
D.A. Summers, et al., Water Jet Cutting of Sedimentary Rock, J. of Petroleum Technology, pp. 797-802 (Jul. 1972).
D.A. Summers, Water Jet Cutting Related to Jet and Rock Properties, 14th Symposium of Rock Mechanics, Penn State University, University Park, Pennsylvania (Jun. 1972).
D.A. Summers, et al., Water Jet Penetration into Rock (Nov. 1970).
D.A. Summers, Waterjet Applications Session Review, 5th Pacific Rim International Conference on Water Jet Technology, New Delhi, India (Feb. 1998).
Well Enhancement Services, LLC, Radial Jet Enhancement Brochure, The Woodlands, Texas (Jun. 2009).
Well Enhancement Services, LLC, Radial Jet Enhancement Brochure, The Woodlands, Texas (Jun. 2009) www.wellenhancement.com.
Halliburton, Hydra Jet Perforating Process Service (4-page brochure setting forth the Hydra-Jet Perforating Process Service (Sep. 2006) www.hlliburton.com.
TIW Corporation, Abrasive Jet Horizontal Drill, A Pearce Industries Company located in Houston, Texas; procedures for the TIW Abrasive Jet Horizontal Drill.
Vortech Oilfield Tools, LP, Vortech Oilfield Tools, www.Vortech-lnc.com; located in Midland, Texas; questions and answers about Vortech tools (publication date unknown).
S.J. Leach, et al., Application of High Speed Liquid Jets to Cutting; vol. 260, plate 60 (1996).
W.C. Cooley, Correlation of Data on Erosion and Breakage of Rock by High Pressure Water Jets; The 12th U.S. Symposium on Rock Mechanics, Missouri (Nov. 1970).
T.J. Labus, Energy Requirements for Rock Penetration by Water Jets; 3rd Int. Symposium on Jet Cutting Technology BHRA Fluid Engineering, Cranfield, Bedford, England (1976).
D.A. Summers, et al., Water Jet Drilling in Sandstone and Granite; Proceedings from the 18th Symposium on Rock Mechanics, Keystone, Colorado (May 1997).
G.Rehbinder, A Theory About Cutting Rock With a Water Jet; J. of Rock Mechanics and Rock Engineering, vol. 12/3-4, (Mar. 1980).
W.C. Maurer, Advanced Drilling Techniques, pp. 229-301; Petroleum Publishing Company (1980).
M. Hashish, Experimental Studies of Cutting with Abrasive Waterjets; 2nd U.S. Waterjet Conference, University of Missouri-Rolla (May 1983).

* cited by examiner

Packer Elements Expanded Inside Casing

Slips Expanded Inside Casing

ELECTRICALLY-ACTUATED RESETTABLE DOWNHOLE ANCHOR AND/OR PACKER, AND METHOD OF SETTING, RELEASING, AND RESETTING

FIELD OF THE INVENTION

The present invention relates to downhole packer and anchoring apparatuses and methods and to downhole operations conducted using such apparatuses and methods.

BACKGROUND OF THE INVENTION

Advances in drilling technology have enabled oil and gas operators to economically "kick-off" and steer wellbore trajectories from a generally vertical orientation to a generally horizontal orientation. The horizontal "leg" of each of these wellbores now often exceeds a length of one mile, and sometimes two or even three miles. This significantly multiplies the wellbore exposure to a target hydrocarbon-bearing formation (or "pay zone"). As an example, consider a target pay zone having a (vertical) thickness of 100 feet. A one-mile horizontal leg exposes 52.8 times as much pay zone to a horizontal wellbore as compared to the 100-foot exposure of a conventional vertical wellbore.

FIG. 1 provides a cross-sectional view of a wellbore 4 having been completed in a horizontal orientation. It can be seen that the wellbore 4 has been formed from the earth surface 1, through numerous earth strata 2*a*, 2*b*, . . . 2*h* and down to a hydrocarbon-producing formation 3. The subsurface formation 3 represents a "pay zone" for the oil and gas operator. The wellbore 4 includes a vertical section 4*a* above the pay zone, and a horizontal section 4*e*. The horizontal section 4*c* defines a heel 4*b* and a toe 4*d*, with an elongated leg there between that extends through the pay zone 3.

In connection with the completion of the wellbore 4, several strings of casing having progressively smaller outer diameters have been cemented into the wellbore 4. These include a string of surface casing 6, and may include one or more strings of intermediate casing 9, and finally, a production casing 12. One of the main functions of the surface casing 6 is to isolate and protect the shallower, fresh water bearing aquifers from contamination by any wellbore fluids. Accordingly, the surface casing 6 is almost always cemented 7 entirely back to the surface 1.

Surface casing 6 is shown as cemented 7 fully from a surface casing shoe 8 back to the surface 1. An intermediate casing string 9 is only partially cemented 10 from its shoe 11. Similarly, production casing string 12 is only partially cemented 13 from its casing shoe 14, though sufficiently isolating the pay zone 3.

The process of drilling and then cementing progressively smaller strings of casing is repeated several times until the well has reached total depth. In some instances, the final string of casing 12 is a liner, that is, a string of casing that is not tied back to the surface 1. The final string of casing 12, referred to as a production casing, is also typically cemented 13 into place. In the case of a horizontal completion, the production casing 12 may be cemented, or may provide zonal isolation using external casing packers ("ECP's), swell packers, or some combination thereof.

Additional tubular bodies may be included in a well completion. These include one or more strings of production tubing placed within the production casing or liner (not shown in FIG. 1). By way of example, but not by way of limitation, tubing strings can be used for purposes of cementing/squeezing, casing testing, hydraulic fracturing, acidizing, other stimulation techniques, production, etc.

In a vertical well completion, the tubing string will typically extend from the surface 1 to a designated depth proximate the production interval 3 and may be attached to a packer (not shown). The packer serves to seal off the annular space between the tubing string and the surrounding casing 12. In a horizontal well completion, the tubing string is typically landed (with or without a packer) at or near the heel 4*b* of the wellbore 4.

In some instances, the pay zone 3 is incapable of flowing fluids to the surface 1 efficiently. When this occurs, the operator may install artificial lift equipment (not shown in FIG. 1) as part of the wellbore completion. Artificial lift equipment may include a downhole pump connected to a surface pumping unit via a string of sucker rods run within the tubing. Alternatively, an electrically-driven submersible pump may be placed at the bottom end of the production tubing. As part of the completion process, a wellhead 5 is installed at the surface 1. The wellhead 5 serves to contain wellbore pressures and direct the flow of production fluids at the surface 1.

Within the United States, many wells are now drilled principally to recover oil and/or natural gas, and potentially natural gas liquids, from pay zones previously thought to be too impermeable to produce hydrocarbons in economically viable quantities. Such "tight" or "unconventional" formations may be sandstone, siltstone, or even shale formations. Alternatively, such unconventional formations may include coalbed methane. In any instance, "low permeability" typically refers to a rock interval having permeability less than 0.1 millidarcies.

In order to enhance the recovery of hydrocarbons, particularly in low-permeability formations, subsequent (i.e., after perforating the production casing or liner) stimulation techniques may be employed in the completion of pay zones. Such techniques include hydraulic fracturing and/or acidizing. Where the natural or hydraulically-induced fracture plane(s) of a formation is vertical, a horizontally completed wellbore allows the production casing to intersect, or "source," multiple fracture planes. Accordingly, whereas vertically oriented wellbores are typically constrained to a single hydraulically-induced fracture plane per pay zone, horizontal wellbores may be perforated and hydraulically fractured in multiple locations, or "stages," along the horizontal leg 4*c*, producing multiple fracture planes.

FIG. 1 demonstrates a series of fracture half-planes 16 along the horizontal section 4*c* of the wellbore 4. The fracture half-planes 16 represent the orientation of fractures that will form in connection with a known perforating/fracturing operation. The fractures are formed by the injection of a fracturing fluid through perforations 15 formed in the horizontal section 4*c*.

According to principles of geo-mechanics, fracture planes will generally form in a direction that is perpendicular to the plane of least principal stress in a rock matrix. Stated more simply, in most wellbores, the rock matrix will part along vertical lines when the horizontal section of a wellbore resides below 3,000 feet, and sometimes as shallow as 1,500 feet, below the surface. In this instance, hydraulic fractures will tend to propagate from the wellbore's perforations 15 in a vertical, elliptical plane perpendicular to the plane of least principle stress. If the orientation of the least principle stress plane is known, the longitudinal axis of the leg 4*c* of a horizontal wellbore 4 is ideally oriented parallel to it such that the multiple fracture planes 16 will intersect the wellbore at-or-near orthogonal to the horizontal leg 4*c* of the wellbore, as depicted in FIG. 1.

In actuality, and particularly in unconventional shale reservoirs, resultant fracture geometries are often more complex than a single, essentially two-dimensional elliptical plane. Instead, a more complex three-dimensional Stimulated Reservoir Volume ("SRV") is generated from a single hydraulic fracturing treatment. Hence, whereas for conventional reservoirs the key post-stimulation metric was propped frac length (or "half length") within the pay zone, for unconventional reservoirs the key metric is SRV. Simply put, the higher the SRV, the better the overall frac effectiveness.

In FIG. 1, the fracture planes 16 are spaced apart along the horizontal leg 4*c*. The desired density of the perforated and fractured intervals along the horizontal leg 4*c* is optimized by calculating: (a) the estimated ultimate recovery ("EUR") of hydrocarbons each fracture will drain, which requires a computation of the SRV that each fracture treatment will connect to the wellbore via its respective perforations; less (b) any overlap with the respective SRV's of bounding fracture intervals; coupled with (c) the anticipated time-distribution of hydrocarbon recovery from each SRV compartment; versus (d) the incremental cost of adding another perforated/fractured SRV compartment.

The ability to make this calculation and replicate multiple vertical fracture networks along a single horizontal wellbore is what has made the pursuit of hydrocarbon reserves from unconventional reservoirs, and particularly shales, economically viable within relatively recent times. This revolutionary technology has had such a profound impact that currently Baker Hughes Rig Count information for the United States indicates only about one out of every fifteen (7%) of wells being drilled in the U.S. are classified as "Vertical", whereas the remainder are classified as either "Horizontal" or "Directional" (85% and 8%, respectively). That is, horizontal wells currently comprise approximately six out of every seven wells being drilled in the United States.

In the initial completion or the re-completion of hydrocarbon-producing and saltwater disposal wells, it is imperative that sufficient zone isolation is maintained as to maximize the effectiveness of any stimulation treatments of the pay zone. This is especially true of a hydraulic fracturing operation, or "frac", particularly in horizontal wellbores in which dozens of frac's are pumped in individual "stages" (wherein multiple sets of perforation "clusters" typically receives a given frac stage). Specifically, in a new well completion (working "toe" to "heel"), prior to stimulating targeted perf clusters with a given frac stage, those perforations must be isolated from any open perf downhole. Even more demanding, in a recompletion scenario, pre-frac zonal isolation may require isolating the target clusters from existing open perforations both downhole and uphole of the target clusters.

One of the preferred . . . and certainly among the most efficient . . . isolation processes is to employ a "single-trip" system. Such a system can accomplish these multiple isolation processes in such a manner as to leave a "clean" wellbore . . . that is, a wellbore free of ball seats, bridge plugs, or other zonal isolation remnants necessitating a cleanout run. The clean wellbore provided by a single-trip system is therefore ready for flowback, for landing the production tubing up and (if necessary) artificial lift equipment, or for other subsequent production operations. To further optimize the frac operation, as many individual intervals or stages as possible would be independently isolated to permit ideal stage spacing, and to do so without adding additional run-in string trips, plug pump downs, or other costly operations. One way to accomplish this multiplicity of zonal isolations for hydraulic fracturing optimization is by using coiled tubing as the retrievable isolation equipment's run-in string, accompanied with annular frac techniques. That is, fracking while the run-in string remains in the wellbore, by either: (a) pumping the frac treatment down the production casing but outside of the run-in string; i.e., pumping only through the run-in string-casing annulus; or, (b) pumping the frac treatment down both the run-in string-casing annulus and also down the run-in string itself. Commonly, when the latter technique is employed, only the annular-pumped frac slurry will contain proppant, while the run-in string slurry will be a 'clean' fluid. This provides for a quick 'reverse-out' of any excess proppant or proppant-laden fluid by simply ceasing annular pumping while continuing pumping down the run-in string.

In the isolation and stimulation of a perforated casing interval in a wellbore, the ability to seal between the well casing and well tubing is paramount. The sealing assembly, or "packer", must be robust enough to withstand downhole temperatures and pressures, and durable enough to be activated and deactivated, or "set" and "released", multiple times. In the two-mile, and longer wellbore lateral lengths characteristic in today's shale play development, for example, upwards of 50 or more frac stages can necessitate dozens or even hundreds of packer setting-and-releasing sequences to provide the requisite zonal isolations. After the isolation and/or stimulation operations are complete, the packer must be retrievable such that the packer can be completely removed from the wellbore and subsequent operations can commence. Current packer technology centers around two general packer types, each employing their respective seal activation methods.

The most common type of resettable packer currently used in the art is a "mechanical" packer, also referred to as a hook wall or conventional packer, that uses axial forces applied via the run-in string to expand or energize solid elastomeric "packer elements". A mechanical packer is used in almost every completion to isolate the annulus from the production conduit, enabling controlled production, injection or treatment. A typical mechanical packer assembly also incorporates a slip arrangement which is actuated to "hook" the casing wall, thereby anchoring the apparatus in place at a desired set point in the well casing.

Another less common type of packer is an "inflatable packer". Inflatable packers comprise hollow, bladder-type packer elements that are expanded by filling the hollow elements with a pressurized fluid, thus causing the elements to expand and seal against the inner casing wall in somewhat of a balloon-like process. In preparation for setting the inflatable packer, a drop ball or series of tubing movements are generally required, with the hydraulic pressure required to inflate the packer provided by carefully applying surface pump pressure."

Another type of packer type is a "cup packer", which utilizes one or more constant casing wall-contacting, swab-type cups that, for a seal against the casing wall, can expand slightly as differential fluid pressure is received in the concave surface of the packer element(s), thereby creating a seal at the cup-casing interface. Accordingly, in a sense, cup-type packers are just another form of hydraulic-set packer. Cup-type packers are typically used in less severe, shallower and/or lower pressure applications.

Of the three prior types of packers just discussed (i.e., mechanical, inflatable, and cup-type), the latter two typically do not incorporate slips, or any other mechanical anchoring mechanism, to establish stationary (static) positioning of the packer at the desired locus within the wellbore.

Another distinction is the power source used for actuating the mechanical operations of setting and unsetting the slips and/or energizing the packer elements. For example, Halliburton Energy Services' "Actuated Inflatable Packer" (shown in WO2019083922A1), uses electric power to move a sleeve in a valve such that an inflation fluid and surface pressure can be used to inflate/deflate an inflatable element. The Actuated Inflatable Packer is apparently designed for lighter duty and does not provide zonal isolation within hydraulic fracturing operations. That is, it has no mechanically set slip segments to rigorously locate the packer, and thus it cannot function as both a tubing anchor and a packer. Since the inflatable element is expanded with pressurized fluid pumped from the surface after an inflation port is opened with an electrically-powered actuator, the pack-off (i.e., the expansion of the packing element) is accomplished via hydraulic power, not electrical power. Accordingly, in WO2019083922A1, electrical power is used only for opening or closing a port, rather than being used to physically expand the inflatable element. Consequently, without the addition of both fluid and pressure, the inflatable element is not and cannot be expanded.

The packing (sealing) elements of a mechanical packer are compressed or energized with a mechanical, axial force to cause expansion, thereby sealing between the run-in tubing, or tubing "string", and the internal casing wall. The pressure inside the element (i.e. "rubber pressure") induced by these mechanical forces, should be sufficient to withstand the external pressure applied during stimulation treatments (and particularly, hydraulic fracturing), testing or other downhole pressure-generating operation.

The slips used in mechanical packers typically have multiple curved rows of hardened serrated teeth, wickers, or other gripping features which are usually case-hardened to bite into or grip against the internal diameter ("I.D.") of the casing wall to thereby keep the packer stationary when external pressure is applied during typical stimulation or testing operations. The slips also typically have angled inner surfaces which ride up on a mating cone beneath the slips which is angled to force the slips radially outward against the casing wall. Alternatively, another common technique utilizes hardened tungsten carbide inserts pressed or braised into a machined or cast cavity in the slip, thus providing a hardened gripping surface on the outside of the slip that will engage the inner surface of the well casing.

Sequentially, the slips of the mechanical packer are set first, thereby providing a stable, stationary resistance to the force used to expand the packer elements. Depending on the particular design, this force can be provided by either set-down or pick-up of the run-in string, or an electric wireline setting tool, hydraulic pressure, or a combination of these methods to provide the required pack-off force to the packer elements. Regardless of how this force is generated, and whether it is made up of tensile and/or compressive forces, the forces are transmitted to the packer elements to generate sufficient packoff force for the packer elements to seal against the inner casing surface. Once the packer is set, the slips remain engaged in the casing wall to keep the packer from moving when external pressure is applied (for example, as during a frac treatment) until the packer is released.

The axial forces for actuating a mechanical packer can be generated using various methods, most of which, aside from a "tubing-set" packer, require a separate setting tool to translate setting forces to the packer. Consequently, these tools, heretofore, have not typically been resettable. The term "resettable" refers to the ability to repeatedly set, then release, and then reset a packer or anchor. The terms "release", "released" or "unset" mean that the energy or packoff force is sufficiently removed from the packer elements and/or slips, such that the packer elements no longer provide an effective seal against the ID of the casing, nor do the slips any longer fix the position of the apparatus within the casing.

The axial force-generating setting sequences produced by setting tools can be initiated with electric wireline power, hydraulic/hydrostatic pressure or combinations thereof. A brief discussion of electric wireline setting tool operation is provided here to differentiate the relevant wireline setting-related methods and apparatuses from the methods and apparatuses presented in the present disclosure. Use of an electric wireline setting tool, e.g. "Baker Hughes Model E-4™ Wireline Pressure Setting Assembly" (WLPSA), initiates the setting sequence of a mechanical packer by passing current from the surface through the wireline firing head to a primary ignitor, that ignites a small cylindrical pellet-shaped secondary power charge that in turn ignites a power charge. The power charge is a gas-generating flammable solid (typically, a UN 1.4S classified explosive) that increases the pressure in the setting tool to move, or "stroke", the setting tool axially and generate the setting force required to set a mechanical packer. Once the packer setting sequence has been completed, the WLPSA "shears off" from the packer through the tensile and/or shear failure of a sacrificial tension sleeve, stud, pin, etc. at a predetermined tensile and/or shear force value. The WLPSA is then retrieved from the well leaving the packer in place such that tubing can be run in the well to engage the packer. The electrical ignition of the primary ignitor inside the firing head of the WLPSA is the sole function which the electric power performs in the wireline setting of a mechanical packer. That is, the packer is set by the power of the explosive . . . NOT by electric power.

Also in contrast to the present invention, when setting an inflatable packer, the inflatable packer relies on the friction between the inflated element and the inner casing wall to hold the packer in place. Some inflatable elements may have reinforcing thin metal strips, slats, or "ribs", and may have the ribs exposed to the wellbore where a portion of the outer rubber cover of the inflatable element has been removed. These exposed ribs are intended to help hold or anchor the inflatable packer in place when the element is inflated against the casing wall. However, the exposed ribs have only the internal pressure within the inflatable element to force them against the casing wall. The hardness and casing-engaging capability of the ribs is limited given the requirement of the ribs to flex as the inflatable element is inflated.

Unfortunately, the frictional forces between an inflated packer element and the casing wall can be overcome by the stimulation pressure applied above the inflated packer. The differential stimulation pressure above the inflated element generally acts on the annular cross-sectional area between the run-in string outer diameter (OD) and the casing inner diameter (ID). The stimulation pressure acting on that annular area and overcoming the frictional forces of the inflatable packing element can cause the packer and the run-in string to move down hole. For example, using 2" OD coiled tubing inside 5-½" OD, 17 #/ft casing (4.892" ID), a differential pressure above the packer of 1,000 psi can generate over 15,000 lbs of downward force on the packer. The downhole movement of the packer and run-in string during a hydraulic fracturing procedure, or "frac", a test, or a stimulation operation can result in failure of the inflatable packer and/or parting of the run-in string due to tensile failure resulting in costly fishing/workover operations. An inflatable element failure would likely occur, however, before parting the run-in string. Nonetheless, a costly round trip of the run-in string to replace the failed packer would be required before stimulation or other operations could resume. Therefore, care must be taken to ensure the differential pressure above the inflatable element is not allowed to exceed the frictional forces of the inflated element against the inner wall of the casing.

Similarly, the differential pressure from below the inflatable element also cannot be allowed to exceed the frictional forces between the inflated element and the casing wall. The differential pressure below the inflatable packer on the bottom of the run-in string generally acts on an area from the ID of the run-in string to the ID of the casing acting to move the inflatable packer uphole. The uphole movement of the packer and the run-in string can cause the packer to fail and/or the run-in string to buckle, resulting in costly round trips of the run-in string to replace the packer and/or damaged tubing. Similar to the previous example with 2" OD, 0.125" wall thickness coiled tubing inside 5-½" 17 #ft. (4.892 ID) casing, a 1,000 psi pressure differential below the inflatable packer at the bottom of the run-in string would generate in excess of 16,000 pounds of upward force on the packer. An inflatable element failure could occur before buckling, or the run-in string could otherwise be permanently deformed. In any case, a costly round trip of the run-in string to replace the failed packer would be required before stimulation operations could resume. Therefore, care must be taken to ensure the differential pressure above the inflatable element is not allowed to exceed the frictional forces of the inflated element against the inner wall of the casing. Pressures generated during hydraulic fracturing operations generally well exceed the 1,000 psi used to illustrate the forces amassed in the previous examples, making inflatable packers less suitable than mechanical packers for fracturing operations, if not entirely unsuitable altogether.

Mechanical packers' superior slip-and-cone anchoring ability, solid cross-section, elastomeric scaling element designs and generally overall higher pressure handling capabilities, as compared, for example, to an inflatable packer, make mechanical packers better suited for higher pressure fracturing, stimulation and testing applications. But current mechanical packer technology has limitations in horizontal wells, especially as the lateral sections in the horizontal wells continue to get longer, often exceeding one, two and even three miles. As a case in point, Surge Energy completed 52 frac stages in April 2019 in their Medusa Unit C 28-09 3AH well with a lateral length of 17,935 feet.

Mechanical packers require axial force to move cones under slips, to simultaneously actuate the slips and to energize the packer elements. However, the 90° transition from the vertical portion of the wellbore to the horizontal portion, or "lateral", and the tremendous length of the horizontal lateral, make the manipulation (i.e., the rotation and/or axial reciprocation) of the run-in string (for both threaded and coiled tubing) for setting and/or releasing the packer elements and/or slips of a mechanical packer very difficult. Consequently, between each perforating and fracking operation for a given "stage", typically it is preferred that wireline plugs be "pumped down" into the lateral and set at their desired placement points. Hence the use of the moniker. "plug-'n-perf", for this the most common of horizontal completion methodologies. Coiled tubing can only be run to certain lateral lengths before downhole oscillation, vibration, or a tractor tool, which actually pulls the distal end of the coiled tubing, must be employed to extend the coiled tubing further into the lateral.

The reciprocation of a coiled-tubing run-in string for operating a resettable mechanical packer can be especially challenging, particularly in longer lateral horizontals and/or laterals drilled along undulating ("porpoising") paths, wherein the amount of "tubing stretch" and friction encountered are often unknown, and can greatly complicate the determination of how much force is actually being transmitted to the packer. In addition, every reciprocation of the coiled tubing run-in string, creates additional fatigue as the coiled tubing passes through the injector head and gooseneck surface equipment thereby reducing the useful life of the coiled tubing with each reciprocating cycle. Coiled tubing reciprocation can also create depth control challenges given the torque and drag issues associated with running pipe through a 90° curve in a horizontal well. Torque and drag force prediction and calculations are so complex that they require specialized torque and drag software packages to fully predict and interpret. Further, reciprocation-only setting and unsetting precludes selective redundancy . . . that is, being able to run two or more packers and/or bridge plugs and select which one(s) are to be actuated. Such redundancy is of huge benefit in longer laterals, where total non-productive time ("NPT") for tripping in and out to replace a failed (single) packer/bridge plug would be cost prohibitive.

However, to date, the only known mechanism capable of repeatably generating sufficient axial forces needed to fully activate a retrievable, resettable mechanical packer multiple times (as required to stimulate multiple stages in a horizontal well) is reciprocation of the run-in string. Consequently, in spite of the difficulties and shortcomings discussed above, reciprocating packer setting/releasing methods are still being used as a means to repeatably set mechanical packers and/or bridge plugs in horizontal well completions. NCS Multistage (NCSM), for example, has used coiled tubing run-in string reciprocation with their "Mongoose" system which incorporates a multi-set bridge plug.

Thus, what is needed is a packer and/or anchor apparatus and method (a) that do NOT require the use of additional run-in string manipulation for isolating the annular space between the run-in string and the well casing, above and/or below an interval of interest, in a horizontal wellbore or a wellbore of any another inclination; (b) that eliminate coiled tubing manipulation-related depth control issues; (c) that can repeatably perform hundreds of zonal isolation cycles in a single run-in string trip, as is typically required in horizontal and especially extended length lateral horizontal well applications; (d) that do not reduce the useful life of the run-in string with each set/release interval isolation cycle; (e) that provide for selective redundancy in running and operating multiple apparatuses; and (f) that allow the apparatus to be placed anywhere in the tool string, in that the apparatus provides for conducting mechanical forces (reciprocation and rotation), hydraulic power (has a closed fluid pathway through it), electric power (conducts a multi-conductor cable through the tool body), and fiber optic capacity (conducts fiber optic line through the tool body) from end-to-end, so that the placement of the apparatus does not preclude any otherwise plausible tool string component sequencing; and, that is compatible with downhole tractors to permit testing and/or stimulation of the entire lateral independent of lateral length.

The apparatus and method will preferably also be robust enough to withstand hundreds of set/release cycles at downhole temperatures and pressures consistent with testing, stimulation and/or hydraulic fracturing operations, particularly common in deeper and/or longer horizontal laterals. The isolation system will preferably be capable of repeatably and reliably isolating downhole intervals of interest from other intervals previously opened and stimulated, regardless of the relative location of the previously opened intervals. Further, the apparatus and method will preferably be able to complete the requirements for all of the lateral isolation operations in a single trip of the run-in string. Thus, the isolation system will preferably be compatible with annular frac procedures in order to leave a clean, production-ready wellbore. Moreover, setting, unsetting, and resetting the apparatus will preferably be achievable without additional run-in string manipulation (e.g., other than that required to move the packer/anchor to the next setting location.) Finally, because unconventional, horizontal well operations typically require so many isolation operations, in order to maintain a "single-trip" operation, multiple apparatuses will preferably be selectively operable, to set/unset/reset for purposes of redundancy, and/or isolating an interval from both above (uphole) and below (downhole).

SUMMARY OF THE INVENTION

The systems and methods described herein have numerous advantages in the conducting of oil and gas well completion activities in cased wellbores of any inclination, and particularly horizontal wellbores requiring multiple hydraulic fracture treatments at relatively high downhole treating pressures. Specifically, when the wellbore can be accessed by an electrical power source, as with an electric line ("e-line"), a tubular-conveyed downhole generator or battery pack, or more preferably, coiled tubing equipped with an electric line ("e-coil").

In one aspect, there is provided an apparatus comprised of an electric motor-actuated mechanical packer and/or anchor (EMAP/A) system, and methods for it application. The (EMAP/A) apparatus provides a means of isolating well intervals of interest from previously opened and/or stimulated intervals utilizing electric motor actuation to set and release one or multiple mechanical packers without additional run-in string manipulation required.

In another aspect, there is provided an apparatus for use in a wellbore. The apparatus preferably comprises a packer and/or anchor assembly having: (a) a body having a longitudinally extending exterior; (b) a linear actuator subassembly in the body which includes and is driven by an electric motor; (c) one or both of (i) a slip subassembly having a plurality of slips on the exterior of the body and/or (ii) a packer subassembly having one or more packer elements on the exterior of the body; and (d) a mechanical linkage subassembly which is linked to the linear actuator subassembly and is moved longitudinally by the linear actuator subassembly to (i) engage the slip subassembly to move the slips outwardly from the body to an anchoring position and/or (ii) engage the packer subassembly to transition the one or more packer elements to a sealing position.

In another aspect, the apparatus can also comprise the electric motor being reversible to (a) set the slips in the anchoring position and/or set the one or more packer elements in the sealing position at one location in a well casing, (b) release the slips from the anchoring position to at least a partially withdrawn position and/or release the one or more packer elements from the sealing position to at least a partially withdrawn position sufficient to at least begin longitudinal movement of the packer and/or anchor assembly in the well casing, and (c) reset the slips in the anchoring position and/or reset the one or more packer elements in the sealing position at another location in the well casing.

In another aspect, there is provided an apparatus for use in a wellbore, wherein the apparatus preferably comprises a packer and/or anchor assembly having: (a) a body having a longitudinally extending exterior; (b) a linear actuator subassembly in the body comprising an electric motor, a screw which is rotated by the electric motor, and a nut positioned on the screw which is locked against rotation and which moves linearly along the screw as the screw is rotated; (c) one or both of (i) a slip subassembly having a plurality of slips on the exterior of the body and/or (ii) a packer subassembly having one or more packer elements on the exterior of the body; and (d) a mechanical linkage subassembly which is connected to the nut and is moved longitudinally by the nut to (i) engage the slip subassembly to move the slips outwardly from the body to an anchoring position and/or (ii) engage the packer subassembly to transition the one or more packer elements to a sealing position.

In another aspect, there is provided a method of performing a downhole operation in a wellbore. The method preferably comprises the steps of: (a) running a tubing string into the wellbore, the tubing string having an electric motor-actuated apparatus positioned on the tubing string or in a tool string connected to the tubing string, the electric motor-actuated apparatus comprising (i) a body having a longitudinally extending exterior, (ii) a linear actuator subassembly in the body which includes and is driven by an electric motor, (iii) one or both of a slip subassembly, having a plurality of slips on the exterior of the body, and/or a packer subassembly having one or more packer elements on the exterior of the body, and (iv) a mechanical linkage subassembly which is linked to the linear actuator subassembly and (b) setting the slips and/or setting the one or more packer elements by activating the electric motor to move the mechanical linkage to (i) engage the slip subassembly to move the slips outwardly to an anchoring position in contact with an interior wall of a casing in the wellbore and/or (ii) engage the packer subassembly to transition the one or more packer elements to a sealing position in contact the interior wall of the casing.

In another aspect, the apparatus and method can further comprise: (I) the electric motor-actuated apparatus being a first electric motor-actuated apparatus which includes both the slip subassembly and the packer subassembly; (II) a second electric motor-actuated apparatus being positioned on the tubing string, or in a tool string connected to the tubing string, below the first electric motor-actuated apparatus, the second electric motor-actuated apparatus comprising (i) a body having a longitudinally extending exterior, (ii) a linear actuator subassembly, in the body of the second electric motor-actuated apparatus, which includes and is driven by an electric motor, (iii) a slip subassembly having a plurality of slips on the exterior of the body of the second electric motor-actuated apparatus, (iv) a packer subassembly having one or more packer elements on the exterior of the body of the second electric motor-actuated apparatus, and (v) a mechanical linkage subassembly which is linked to the linear actuator subassembly of the second electric motor-actuated apparatus and is moved longitudinally by the linear actuator subassembly of the second electric motor-actuated apparatus; (III) step (b) comprising setting both the slips and the one or more packer elements of the first electric motor-actuated apparatus; (IV) the method further comprising the step, before, during, or after step (b), of (c) setting the slips and the one or more packer elements of the second electric motor-actuated apparatus by activating the electric motor of the second electric motor-actuated apparatus to move the mechanical linkage of the second electric motor-actuated apparatus to (i) engage the slip subassembly of the second electric motor-actuated apparatus to move the slips of the second electric motor-actuated apparatus outwardly to an anchoring position in contact with the interior wall of the casing and (ii) engage the packer subassembly of the second electric motor-actuated apparatus to transition the one or more packer elements of the second electric motor-actuated apparatus to a sealing position in contact the interior wall of the casing; and (V) steps (b) and (c) forming a sealed annular interval in the casing, outside of the bodies of the first and second electric motor-actuated apparatuses, which extends from the one or more packing elements of the first electric motor-actuated apparatus to the one or more packing elements of the second electric motor-actuated apparatus.

In another aspect, the apparatus and method can further comprise: (i) the linear actuator subassembly of either or both of the electric motor-actuated apparatuses also including an electronic unit for activating the electric motor and/or (ii) supplying power to the electric motor and sending signals to the electronic unit via an electric cable or other electric wireline which extends through or is incorporated in the tubing string. The tubing string is preferably an e-coil tubular.

In another aspect, the apparatus and method can further comprise the sealed annular interval being at a first location in the casing and wherein the method can further comprise the steps, after steps (b) and (c), of (I) activating the electric motors of the first and second electric motor-actuated apparatuses to (i) release the slips of the first and second electric motor-actuated apparatuses to an at least partially withdrawn position and (ii) release the one or more packer elements of the first and second electric motor-actuated apparatuses to an at least partially withdrawn position sufficient to at least begin longitudinal movement in the casing, (II) using the tubing string to move the first and second electric motor-actuated apparatuses to a second location in the casing different from the first location, and then (III) resetting the slips and resetting the one or more packer elements of the first and second electric motor-actuated apparatuses at the second location to form a sealed annular interval in the casing at the second location, outside of the bodies of the first and second electric motor-actuated apparatuses, which extends from the one or more packing elements of the first electric motor-actuated apparatus to the one or more packing elements of the second electric motor-actuated apparatus.

Small electric motor and gearing technologies now available can provide the torsional force yields required to set and release/unset the downhole packer assembly of the present invention . . . that is, to generate well into the thousands of psi setting force. One or more EMAP/As can be set and released without any pipe rotation being required. This avoids torsional failure issues including twisting the run-in string in two (typically resulting in a costly fishing operation), over-torqueing connections resulting in thread damage and/or run-in string leakage, and backing off a connection which can also result in a costly fishing operation.

In addition to avoiding rotational manipulation, the EMAP/A apparatus can be set and released without any additional coiled tubing or other run-in string reciprocation being required. This extends the useful life of the run-in string, especially in the cases where the run-in string is coiled tubing that suffers additional fatigue with each movement of the coiled tubing over a stress-inducing injector head and gooseneck. Furthermore, the EMAP/A apparatus' selective set and release capability allows the EMAP/A packer-anchor system to accommodate various packer placement configurations.

The electro-mechanical setting process utilizing the ball screw linear actuation system preferably enables the unique operational flexibility to utilize the EMAP/A apparatus in an anchor-only application, e.g. where flow past the tool string may be desirable while maintaining the tool string location stability for whipstock orientation or other operations. This flexibility is preferably enabled through reversing the travel of a ball screw to pull the slip body underneath a set of slips and in so doing, setting/engaging the slips in the casing to anchor the tool string, while electronically preventing directionally opposing travel of the ball screw system that would subsequently cause the slips to move over the slip body with continued ball screw movement forcing packer elements to seal against the casing ID. Thus, in an anchor-only application, the EMAP/A can preferably be set and released without energizing the packer elements. This extends the life of the packer element system, thus further providing for single-trip completion of multiple stages in extended lateral applications.

The selective set and release capability is preferably achieved through the use of independent power sources and electronic switching interfaces for each individual packer apparatus which is included in the tubing string, enabling each packer to be set and released independently of other packers in the system regardless of the packer's relative location in the string.

The EMAP/A's ability to be configured for single packer applications, multiple redundant packer applications and straddle packer applications through the EMAP/A's selective set capability adds flexibility in how intervals of interest are isolated. A single packer system, for example, would allow a "traditional" bottoms up, or toe-to-heel, multistage annular fracturing while enabling redundant yet independent packers to be run in a backup role. This will provide additional reliability in extended lateral or other more demanding applications, including high temperature and high pressure well environments.

Likewise, a multiple packer system can be used where straddle isolation is required where previously open intervals exist both uphole and downhole from the interval of interest or where multiple intervals of interest need to be isolated simultaneously.

In a straddle EMAP/A configuration, the interval of interest could be stimulated or tested down the run-in string. The relative spacing of the selective-set EMAP/A apparatuses to one another is highly configurable. For example, when utilizing e-coil (coiled tubing as the run-in string, with integrated electric wireline inside or otherwise incorporated in or running through the coil, thereby supplying electric power along the entire run-in string) and real-time data acquisition back to the surface, as when e-coil is paired with fiber optic cable. One example of an e-coil and real-time optical fiber-enabled data acquisition system is Halliburton's SPECTRUM® FUSION Real-Time Coiled Tubing system.

An "e-coil", or "smart coil", can be any reel-deployed, or "coiled", tubing system that includes wireline capabilities, and may or may not include fiber optic capability.

The advent of e-coil technology paired with fiber optic cable and positional, tool face, pressure and temperature sensor packages for real-time data acquisition, like the Halliburton SPECTRUM® FUSION system, also broadens the applicability of the inventive EMAP/A apparatus. The ability to get real-time pressure and temperature data at bottomhole conditions both above and below the EMAP/A apparatus(es) make it possible to determine where the frac is going and if need be, to shut down and even skip particular frac stages due to pressure communication around the EMAP/A apparatus-isolated intervals. In the event communication is detected, e.g. through the reservoir or behind pipe due to poor/no cement bond to the casing, new stimulated reservoir volume, or "SRV", is not being created or at least not efficiently. If SRV is not being created, then the value generated by pumping fluid and proppant volumes per the initial frac design is greatly diminished if not eliminated completely. The ability to make those go, no-go decisions in real-time on a stage by stage basis can greatly influence the effectiveness of the typically multi-million dollar fracturing operation, which can be 50% or more of the entire drilling and completion (D&C) expenses for a typical horizontal shale well.

As with augmenting the EMAP/A apparatus e-coil and fiber optic tool string with temperature and pressure sensors, the addition of positional/orientation sensors, like those described in the Halliburton SPECTRUM® FUSION literature, likewise provides valuable real-time information while enabling additional functionality. With real-time position/orientation information, the EMAP/A system and sensor packages further extend the capabilities of the Coiled Tubing Specialties', or "CTS", Downhole Hydraulic Jetting Assembly (U.S. Pat. Nos. 9,976,351, 10,309,205, and 10,323,493) by providing real-time orientable whipstock directional data such that precise orientation of the hydraulically-jetted mini-lateral boreholes can be determined.

Likewise, the alignment, engagement and proper orientation of the aforementioned CTS orientable whipstock into and with the CTS Ported Casing Collar (U.S. Patent Application 20190162060), including, the casing collar's dynamic port-opening/closing inner sleeve positioning, can be confirmed and/or repositioned real-time. This confirmation and/or repositioning can be done prior to the shifting the Ported Casing Collar's inner sleeve and the subsequent hydraulic jetting operations to exit the casing or sleeve and create the mini-lateral boreholes. The 1.5" diameter mini-lateral boreholes up to 300' in length are jetted in a direction typically in the same horizontal plane yet transverse to the horizontal wellbore, e.g. in an easterly or westerly mini-lateral path from the north-south wellbore.

The inventive EMAP/A apparatus is also well suited for use in fracturing operations in which (a) fracturing fluid is pumped down the annulus between the tubing string and the interior wall of the casing or (b) fracturing fluids are pumped both though the annulus and through the tubing string, which is preferably an e-coil. Preferably, the fracturing fluid pumped down the annulus will include a proppant material, but the fracturing fluid pumped through the tubing string will not.

DETAILED DESCRIPTION OF THE PREFERRED EMBODIMENTS

Figure 1:
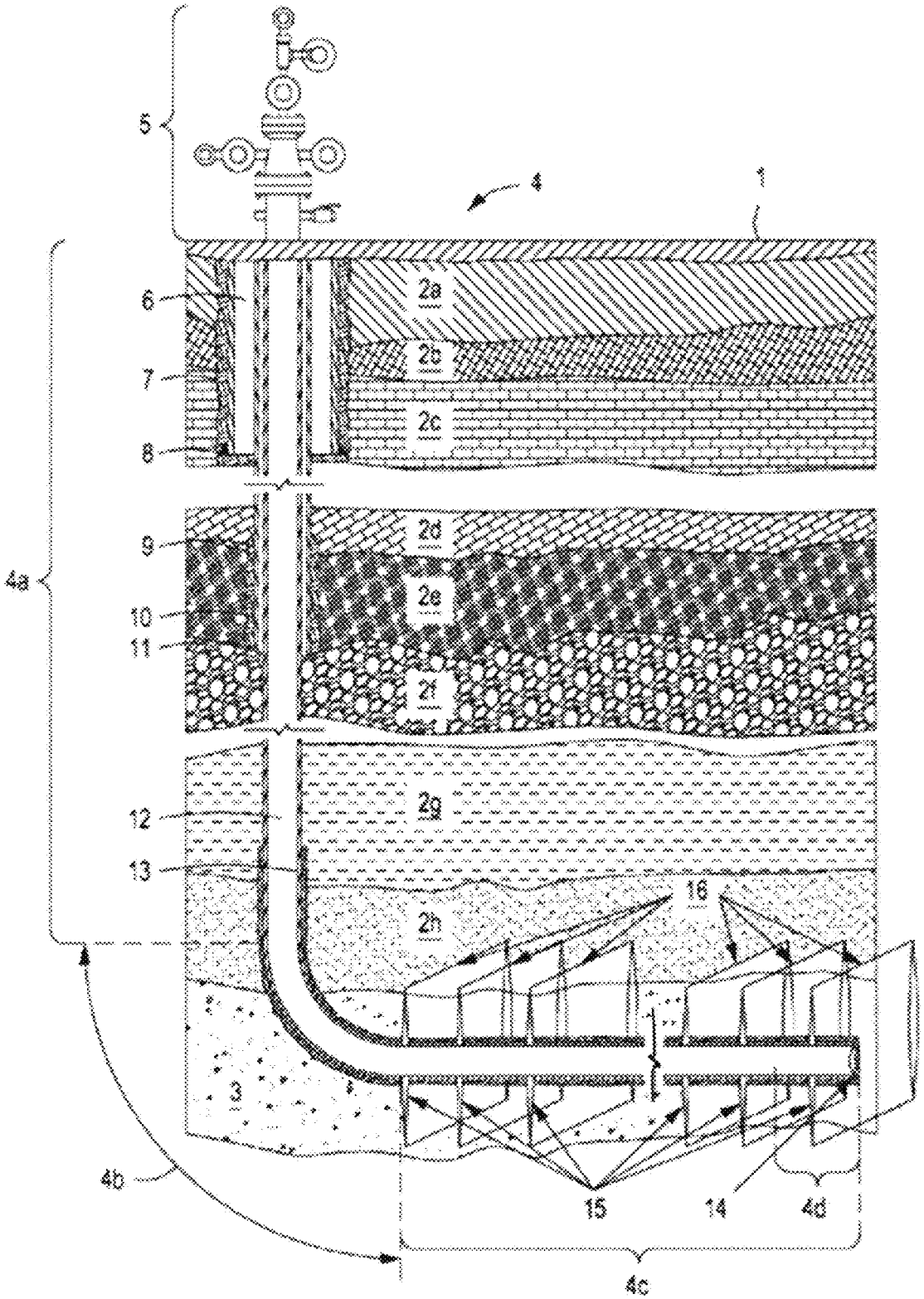
FIG. 1 provides a cross-sectional view of a wellbore having been completed in a horizontal orientation.
Figure 2:
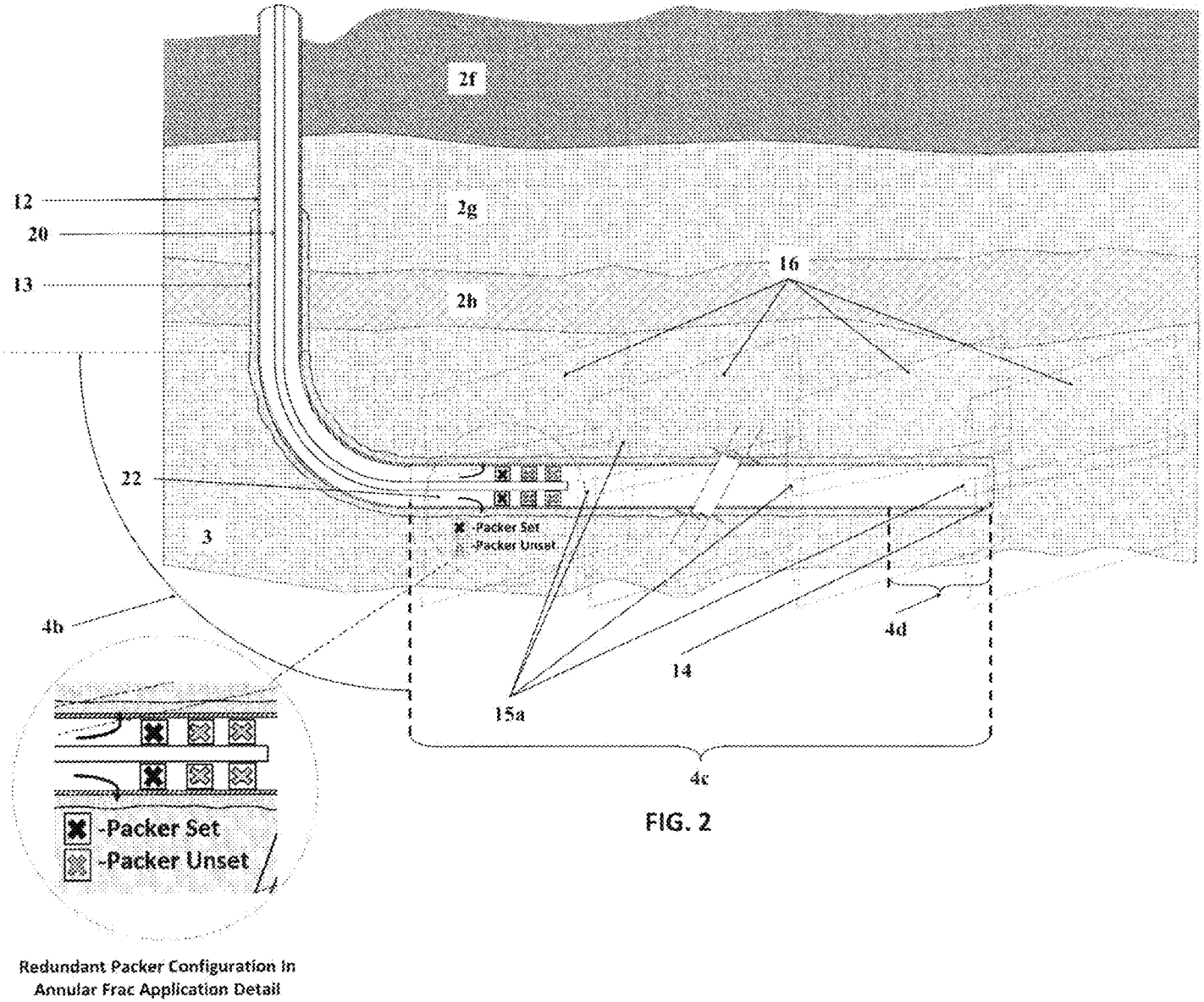
FIG. 2 is a cross-sectional view of an illustrative horizontal wellbore with e-coil conveyed electric motor-actuated packer/anchor (EMAP/As) apparatuses deployed in an annular frac application. Multiple packers are shown in the figure to represent both set and unset configurations in a redundant packer installation.

FIG. 2 is a cross-sectional view of an illustrative horizontal wellbore 4*c* with multiple inventive, e-coil conveyed, electric motor-actuated packer and/or anchor assemblies (EMAP/As) 100 deployed in an annular frac application. Multiple EMAP/As 100 are shown in FIG. 2 to represent both set and unset configurations in a redundant packer installation. The ability to run and selectively actuate multiple assemblies 100 both above and below the desired isolation interval greatly increases reliability, especially in extended lateral and/or tighter stage spacing applications requiring increasing demands through additional packer actuating-releasing (or "setting-unsetting") cycles. Half-fracture planes 16 are shown in 3-D along a horizontal leg 4*c* of the wellbore to illustrate fracture stages and fracture orientation relative to a subsurface formation 3. The fractures have been created through Ultra Deep perforations (UDP's) 15*a* in the production casing 12.

It can be seen that the EMAP/A apparatus system has been conveyed into the lateral on an e-coil (or e-coil and fiber optic) tubing string 20 to allow electric power to be conveyed from the surface (and/or data to the surface). Furthermore, it can be seen that some of the inventive EMAP/As 100 are actuated (or "set") by the bold "X" representing the packer element section 106.0 for each EMAP/A system 100. The lighter font "X" is used to indicate packer elements 106.0 that are unset or "released". It can also be seen that although the other packers 106.0 are shown in the released position, any and all of the packers 106.0 can be selectively actuated as interval isolation operations proceed requiring additional packer setting-releasing cycles.

Figure 3:
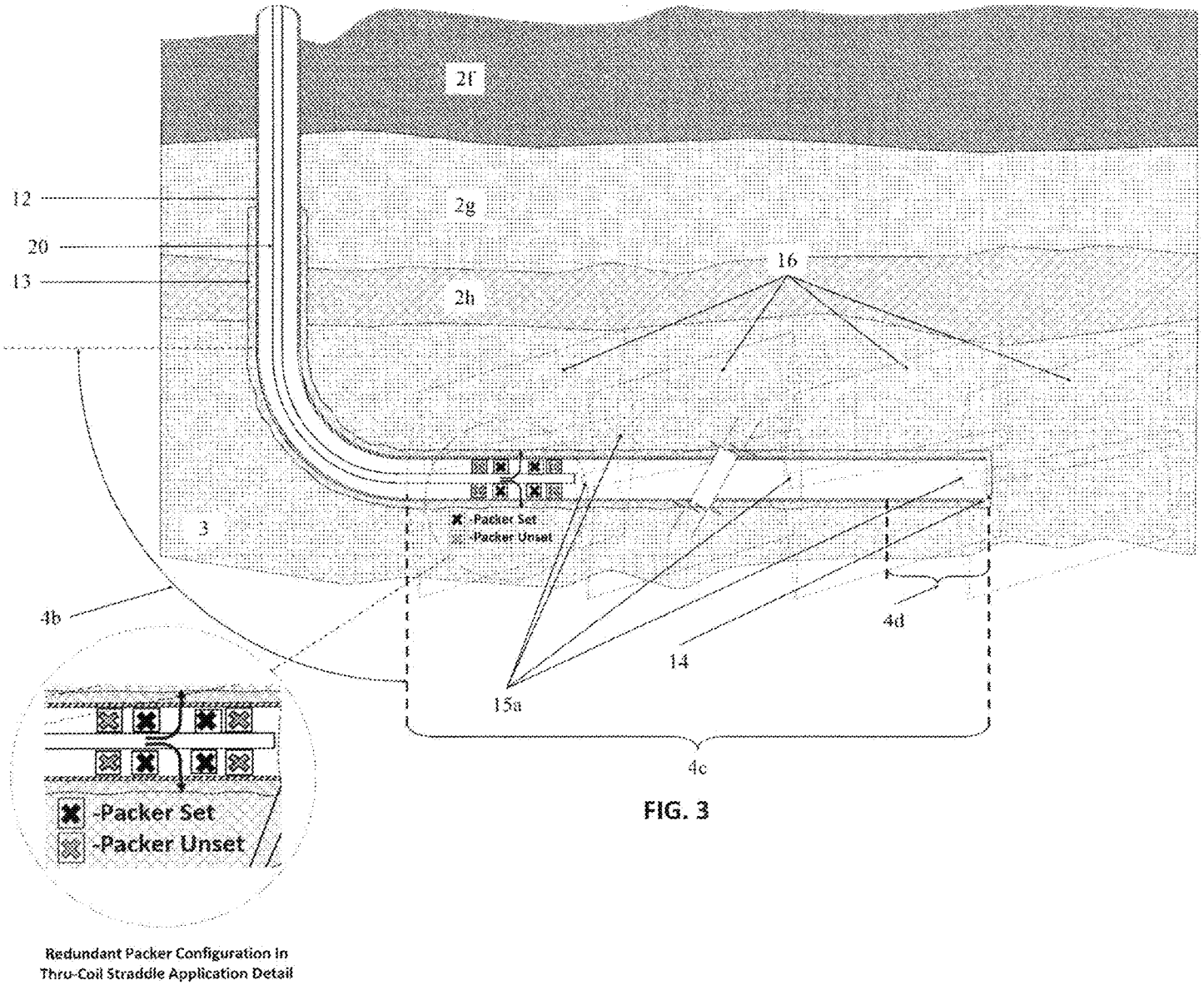
FIG. 3 is a cross-sectional view of an illustrative horizontal wellbore with e-coil conveyed electric motor-actuated packer and/or anchors EMAP/A's apparatuses deployed in a casing testing, cement squeezing, or stimulation application. Multiple packers are shown in the figure to represent both actuated (set) and non-actuated (unset) configurations in a redundant packer installation.
Figure 4:
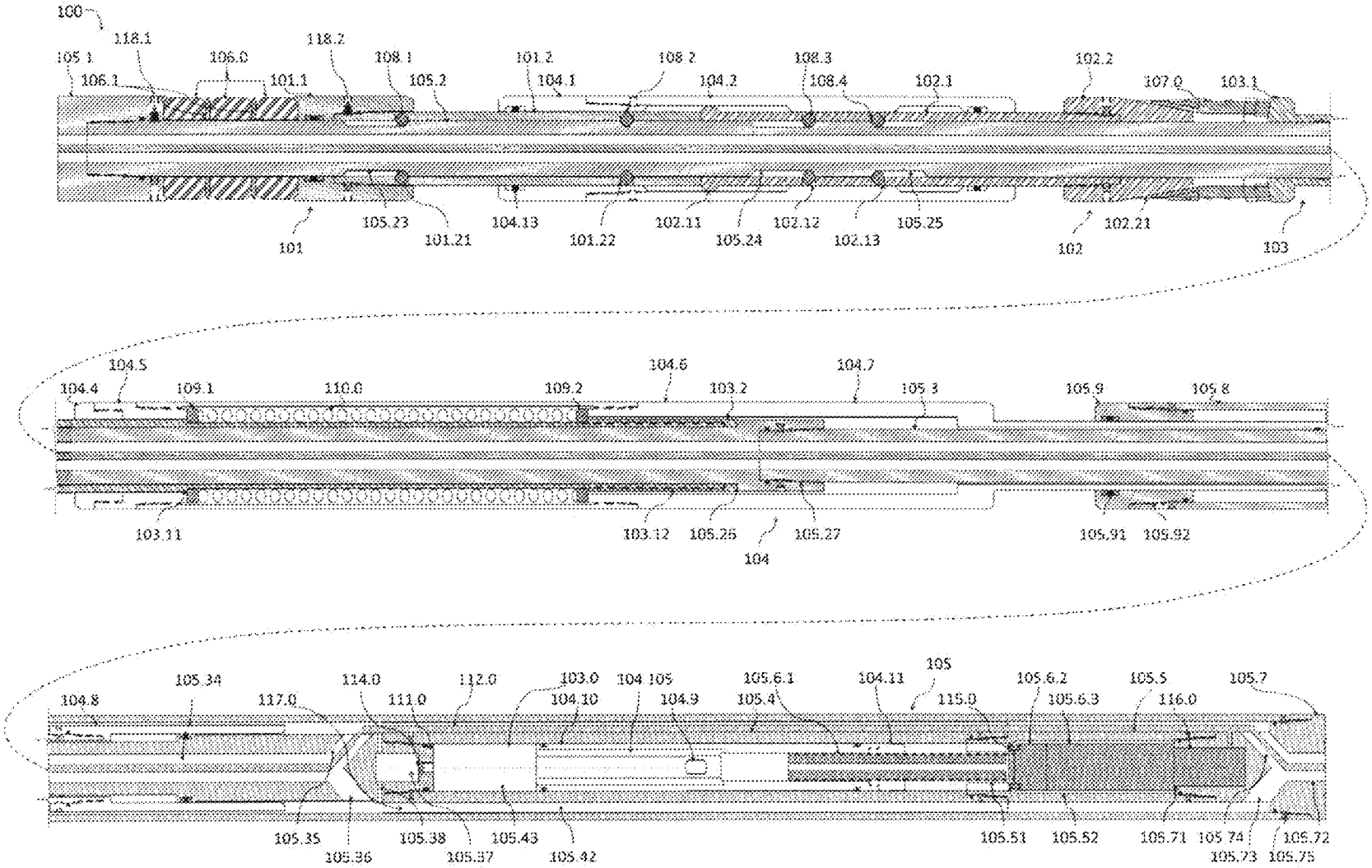
FIG. 4 is a cross-sectional view of an embodiment 100 of the inventive electric motor-actuated packer and/or anchor EMAP/A apparatus provided by the present invention in an unset position.
Figure 5A:
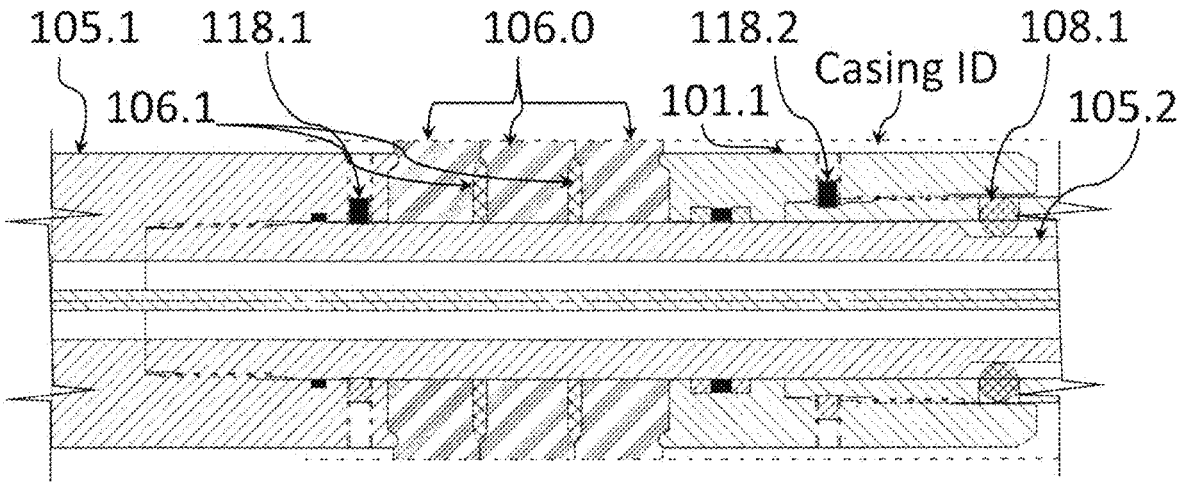
FIGS. 5*a* and 5*b* are detail cross-sectional views of the EMAP/A apparatus 100 showing the packer element and slip sections, respectively, in the set position.
Figure 5B:
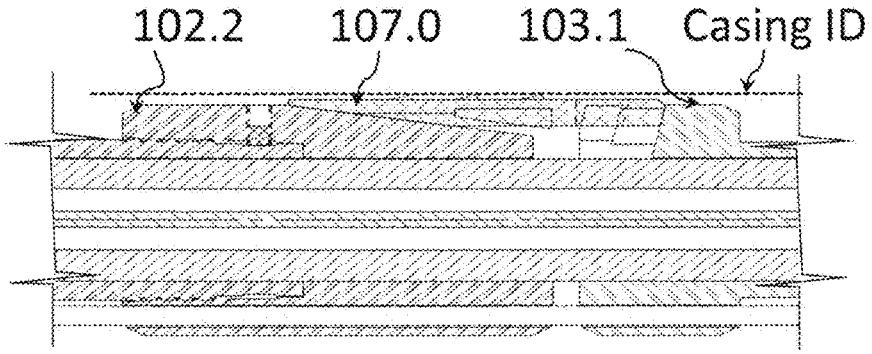
Figure 6:
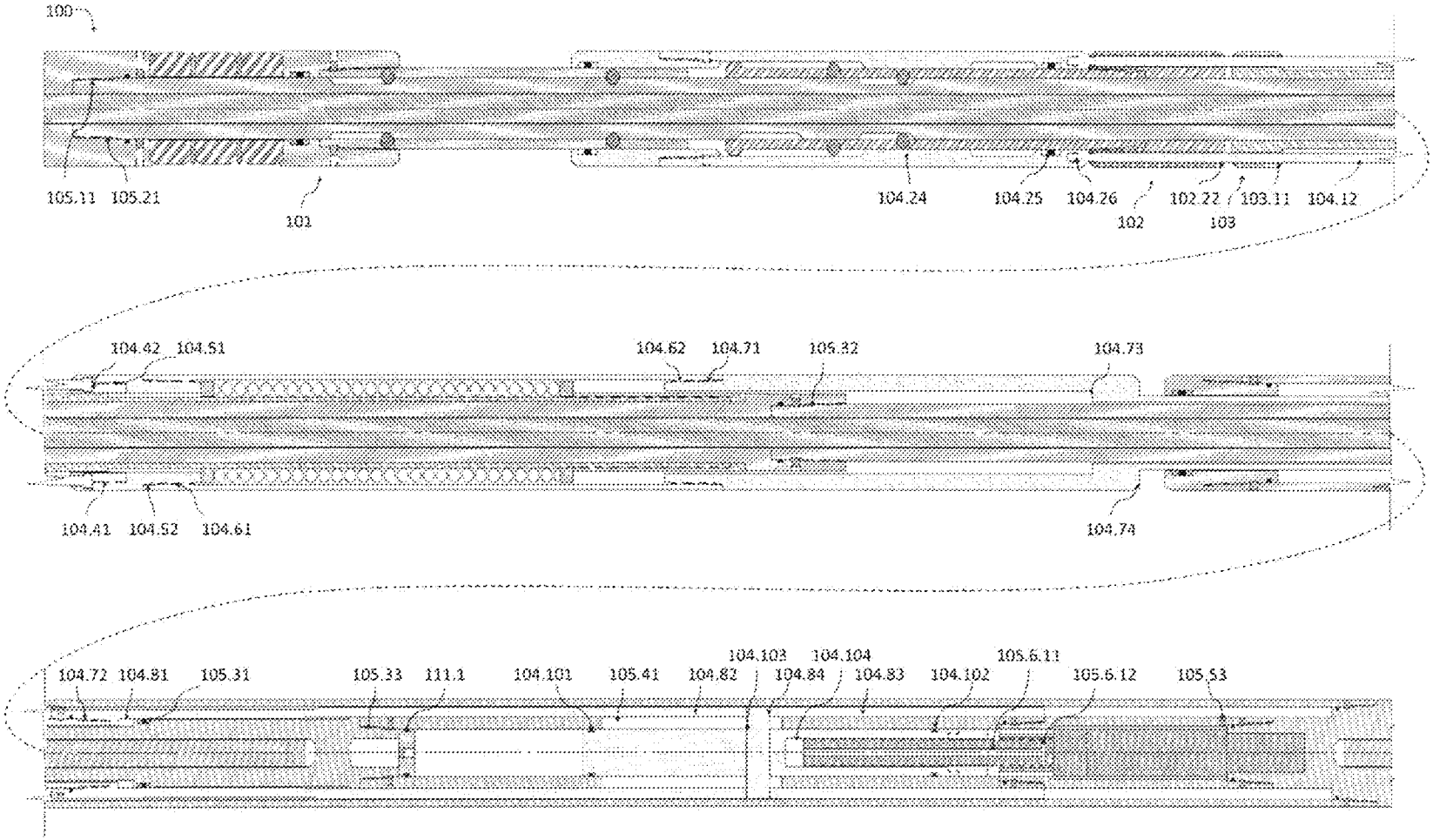
FIG. 6 a cross-sectional view of the inventive EMAP/A apparatus 100 rotated 90° from FIG. 4.

The capability to run multiple uphole and/or downhole packer assemblies 106.0 and to selectively set and release each packer 106.0 independently of the others provides the additional isolation reliability required to permit virtually any number of stages and any length of lateral to be isolated, tested and stimulated pursuant to operational requirements. In addition, one or more of the inventive EMAP/A assemblies 100 can be installed in the e-coil tubing string in an inverted position in order to isolate a zone of interest from both above and below in a straddle EMAP/A configuration as depicted in FIG. 3.

The embodiment of the inventive Electric Motor Actuated Packer and/or Anchor (EMAP/A) apparatus 100 shown in FIGS. 4, 5A, 5B and 6 is an electrically actuated dual purpose tool which comprises both a mechanical packer subassembly 101 and a mechanical anchor subassembly 102. The EMAP/A apparatus 100 is e-coil conveyed and operated, being set and unset using an electro-mechanical linear actuator subassembly 105, if utilized in a radial hydraulic jetting operation, it may be preferred that only the slips 107.0 are set to hold the EMAP/A apparatus 100 in position (i.e., "anchor mode"), thus providing hydraulic communication in the tool string—casing annulus 22. During hydraulic fracturing operations, however, both the packer elements 106.0 and the slips 107.0 are set (i.e., in a "packer mode"), reducing stress and possible damage to the packer elements 106.0 (as would be experienced by an inflatable packer, typically without slip-holding capabilities).

It should be noted that, by the design of the inventive EMAP/A apparatus 100 in the genre of mechanical packers, any hydraulic differential pressure imposed upon the top surface of the packer elements 106.0 will be transferred through the body of the apparatus down to the slips 107.0. That is, more top-down (hydraulic) force just causes the slips 107.0 to "bite harder" into the inner casing wall.

The inventive EMAP/A apparatus 100 preferably comprises: the lower packer shoe subassembly 101, the slip wedge subassembly 102, a slip retainer subassembly 103, a key sleeve subassembly 104, an actuator subassembly 105, the packer elements 106.0, the slips 107.0, retaining balls 108.1-108.4, spring retainers 109.1-109.2, a spring 110.0, a pressure equalizing piston 111.0, a flat (wireline) cable 112.0, and hydraulic oil 103.0.

The lower packer shoe subassembly 101 is used to set and unset the packer elements 106.0. It comprises a lower packer shoe 101.1 and a lower packer shoe sleeve 101.2. The lower packer shoe 101.1 is threadedly attached to or otherwise made up on the upper end of the lower packer shoe sleeve 101.2 and holds the lower end of the packer elements 106.0 in place. The lower packer shoe sleeve 101.2 transfers load to the lower packer shoe 101.1 to set and unset the packer elements 106.0 and has two sets of radial holes 10121, 101.22 which contain retaining balls 108.1, 108.2.

As used herein, the terms "upper" and "lower" and the terms "upward" and "downward" refer to relative uphole and downhole positions, locations, or movements in horizontal and other orientations of the inventive apparatus 100.

The slip wedge subassembly 102 is used to set and unset a plurality of slips 107.0. It comprises a slip wedge sleeve 102.1 and a slip wedge 102.2. The slip wedge sleeve 102.1 is threadedly attached or otherwise made up to the upper end of the slip wedge 102.2. It has an external upset 102.11 at the upper end and two sets of radial holes 102.12, 102.13 which contain retaining balls 108.3, 108.4. The slip wedge 102.2 contains slip pockets 102.21 in which the upper end of slips 107.0 move during setting and unsetting operations. The slip wedge 102.2 also contains longitudinal holes 102.22 between slip pockets through which load transfer screws 104.12 extend.

The slip retainer subassembly 103 is used to preload and contain the spring 110.0 and spring retainers 109.1, 109.2. It is also used to set and unset the slips 107.0. It comprises the slip retainer 103.1 and the spring compression nut 103.2. The slip retainer 103.1 contains t-slots at the upper end in which the lower end of slips move during setting and unsetting operations. An external shoulder 103.11 at the upper end restricts longitudinal movement of the upper spring retainer 109.1. External threads 103.12 at the lower end allow make-up of the compression slip nut 103.2 to compress the spring 110.0. The spring compression nut 103.2 contains an internal thread and is made up on the lower end of the slip retainer 103.1 to compress the spring 110.0. The upper end of the compression nut 103.2 restricts longitudinal movement of the lower spring retainer 109.2.

The key sleeve subassembly 104 is used to transfer setting and unsetting forces from the linear actuator sub-subassembly 105.6 to the packer elements 106.0 and slips 107.0. It is also used to lock and unlock the lower packer shoe 101 and slip wedge 102 subassemblies from the actuator subassembly 105 using retaining balls 108.2-108.4. The key sleeve subassembly 104 comprises a ball retainer shoe 104.1, a ball retainer 104.2, the load transfer screws 104.12, a screw retainer 104.4 which holds the lower ends of the screws 104.12, an upper spring shoe 104.5, a spring housing 104.6, a lower spring shoe 104.7, a key sleeve 104.8, the key 104.9 which is carried by the key sleeve 104.8, a key body 104.10 and a ball nut 104.11.

The ball retainer shoe 104.1 contains an internal seal 104.13 at the upper end that seals against the lower packer shoe sleeve 101.2 OD. The lower end of the ball retainer shoe 104.1 is threadedly attached or otherwise made up to the ball retainer 104.2. The ball retainer 104.2 includes an internal upset 104.24 in the middle with undercuts on each side, an internal seal 104.25 at the lower end that seals against the slip wedge sleeve 102.1, and longitudinal threaded holes 104.26 at the lower end which threadedly receive the upper ends of the load transfer screws 120. Longitudinal movement of the ball retainer 104.2 covers/retains and uncovers/releases retaining balls 108.3, 108.4, respectively locking and unlocking the lower packer shoe 101 and slip wedge 102 subassemblies to the actuator subassembly 105.

The load transfer screws 104.12 extend from the screw retainer 104.4 to the threaded holes 104.26 at the lower end of the ball retainer 104.2 and go through longitudinal holes 103.11 and 102.22 in the slip retainer 103.1 and slip wedge 102.2, respectively. The load transfer screws 104.12 provide the means of transmitting the longitudinal loads from the lower components of the key sleeve subassembly 104 to the ball retainer 104.2. The screw retainer 104.4 has an external thread 104.41 at the lower end which is made up in the upper end of the upper spring shoe 104.5. The screw retainer 104.4 also has longitudinal holes and counterbores 104.42 drilled between the OD and ID of the retainer 104.4 in which are located the heads of the load transfer screws 104.12.

The upper spring shoe 104.5 has an internal thread 104.51 at the upper end and an external thread 104.52 at the lower end. The upper end is made up to the screw retainer 104.4 to lock the load transfer screws 104.12 in the screw retainer 104.4. The lower end is made to the spring housing 104.6.

The spring housing 104.6 has internal threads 104.61, 104.62 at its upper and lower ends. The upper end is made up to the upper spring shoe 104.5 and the lower end is made up to the lower spring shoe 104.7. The spring housing 104.6 covers the spring 110.0. The lower spring shoe 104.7 has external threads 104.71, 104.72 at its upper and lower ends with internal and external shoulders 104.73, 104.74 at an intermediate location. The upper end is made up to the spring housing 104.6 and the lower end is made up to the key sleeve 104.8.

The key sleeve subassembly 104 provides a mechanical linkage between the linear actuator subassembly 105.6 and the packer and slip subassemblies 101, 102, 103 for setting, releasing and resetting the packer elements 106.0 and the slips 107.0.

The key sleeve 104.8 has an ID bore 104.81 that seals against an external seal 105.31 on the mandrel 105.3. Below the ID bore 104.81 are two arms 104.82 180 degrees apart with two milled slots 104.83 centered at the lower ends of the arms 104.82. The key 104.9 is inserted through the two slots 104.84 at the lower end of the key sleeve arms 104.82, through two longitudinal slots 105.41 in the key guide 105.4, and through a slot in the key body 104.10. The key 104.9 transfers forces used to set and unset the packer elements 106.0 and slips 107.0 from the key body 104.10 to the key sleeve arms 104.82 through the slots 105.41 in the key guide 105.4.

The key body 104.10 has external seals 104.101, 104.102 at the upper and lower ends, a radial slot 104.103 for the key 104.9 in the center portion thereof, an ID bore 104.104 at the lower end, and longitudinal holes 104.105 on each side of the slot 104.103 extending from the upper end to the ID bore 104.104. A nut, preferably a ball nut, 104.11 is made up on the lower end of the key body 104.10 and is used to convert torsional forces from a screw, preferably a ball screw 105.6.1, to longitudinal forces (i.e., longitudinal movement of the key sleeve assembly 104) to set and release the packer elements 106.0 and/or the slips 107.0 of the inventive EMAP/A apparatus 100.

The nut 104.11 can be any type of internally threaded member which can be positioned on the screw 105.6.1 for linear movement of the nut 104.11 as the screw 105.6.1 is rotated. The screw 104.11 is preferably a ball screw. As used herein, the term "ball nut", or "nut", is part of the ball screw assembly and provides a means to translate the rotary motion of the ball screw "shaft" into linear motion through the halls/bearings. The ball nut is available in various forms including flanged, threaded, etc. depending on the specific application, load requirements, etc.

The screw 105.6.1 used in the linear actuator subassembly 105.6 can be any type of longitudinally extending, externally threaded member which is effective for moving the nut 104.11 longitudinally to convert the rotary motion of the electric motor 105.6.3 to linear motion. The screw 105.6.1 will preferably be a ball screw. The ball screw 105.6.1 and the ball nut 104.11 assembly will preferably include recirculating ball bearings such that the interface between the ball screw 105.6.1 and the ball nut is 104.11 is made by ball bearings which roll in matching ball forms.

The actuator subassembly 105 preferably comprises: upper packer shoe 105.1 at the upper end of the inventive apparatus 100, a upper packer mandrel 105.2, a lower mandrel 105.3, the key guide 105.4, an actuator housing 105.5, actuator sub-subassembly 105.6, an actuator shoe 105.7, an actuator housing 105.8 and an actuator shoe 105.9 at the lower end of the inventive apparatus 100. The upper packer shoe 105.1, the a upper packer mandrel 105.2, the lower mandrel 105.3, the key guide 105.4, the actuator housing 105.5, the actuator shoe 105.7, the actuator housing 105.8, and the actuator shoe 105.9 form a body of the inventive EMAP/A apparatus 100 which has a longitudinally extending exterior, on and around which the slips 107 and the one or more packer elements 106 are located. The actuator sub-assembly 105.6 is located within the body.

The upper packer shoe 105.1 has an internal thread 105.11 at its lower end that is made up on the upper end of the packer mandrel 105.2. The packer shoe 105.1 holds the upper end of the packer elements 106.0 in place. The upper end of the upper packer shoe 105.1 can be adapted to accommodate connecting to other tools or components located above the EMAP/A apparatus 100.

The packer mandrel 105.2 upper end has an external thread 105.21 that makes up in the lower end of the upper packer shoe 105.1. The packer mandrel 105.2 extends through and holds thereon the packer elements 106.0, the lower packer shoe 101.1, the slip wedge sleeve 102.1 the slip wedge 102.2, and the slip retainer subassembly 103. The packer mandrel 105.2 has external undercuts 105.23-105.25 into which retaining balls 108.1-108.4 are extended and locked to hold the lower packer shoe 101 and slip wedge 102 subassemblies in place. The lower end of the packer mandrel 105.2 has an external shoulder or other upset 105.26 and internal threads 105.27 which make up to the lower mandrel 105.3. The lower end of the slip retainer subassembly 103 shoulders against the external upset 105.26 of the packer mandrel 105.2 which limits the downward movement of the slip retainer subassembly 103 when only the slips 107.0 are set.

The lower mandrel 105.3 is comprised of an upper end that has an external thread 105.32 which makes up in the packer mandrel 105.2. The mid portion of the lower mandrel 105.3 has an external seal 105.31 and the lower end has an external thread 105.33 which makes up in the key guide 105.4, while the ID bore 105.34 of the lower mandrel 105.3 extends from the upper end to near the lower end where it intersects two downward angled ports 105.35, 105.36. The lower end of the lower mandrel 105.3 contains an ID bore 105.37 with radial ports 105.38 to its OD.

The key guide 105.4 is made up on the lower end of the lower mandrel 105.3 and has an ID bore 105.43 extending through its length. The lower end is made up to the actuator housing 105.5.

The OD of the key guide 105.4 has four longitudinal grooves 105.42 at 90° running the length of the key guide 105.4. Two of the grooves 105.42 at 1800 apart have a longitudinal slot 105.41 for the key 104.9 milled through the bottom of each of the grooves and into the ID of the key guide 104.9. Each slot 105.41 is centered in its respective groove 105.42 and is aligned with the slot in the opposite groove. The two OD grooves 105.42 without slots in them are aligned with the two angled ports 105.35 and 105.36 in the mandrel 105.3. The slots 105.41 located in the grooves 105.42 are 90 degrees offset from the angled ports 105.35 and 105.36.

The actuator housing 105.5 is threadedly connected to or otherwise made up on the lower end of the key guide 105.4. The actuator housing 105.5 has a small ID bore 105.51 at the upper end and a larger ID bore 105.52 below the small ID bore 105.51. Longitudinal holes and counterbores for hex socket screws 115 are spaced around the upper end of the actuator housing 105.5, with longitudinal holes for fluid flow located between them, while a hydraulic oil fill port 105.53 is located at the lower end.

The linear actuator sub-subassembly 105.6 is comprised of the ball screw 105.6.1, a gearhead 105.6.2, and an electric motor 105.6.3 with Hall-effect sensors. The linear actuator sub-subassembly 105.6 is located in the actuator housing 105.5 with the ball screw 105.6.1 extending through the upper end of the actuator housing 105.5. Hex socket cap screws 115.0 are inserted through the longitudinal holes and counterbores at the upper end of the actuator housing 105.5 and are made up in the gearhead 105.6.2 to hold the linear actuator sub-subassembly 105.6 in place. The gearhead 105.6.2 and electric motor 105.6.3 OD's are smaller than the actuator housing 105.5 ID to allow movement of oil through external ports in the gearhead 105.6.2 and electric motor 105.6.3. The ball screw 105.6.1 has a longitudinal hole 105.6.11 intersecting radial holes 105.6.12 at the lower end. The position of the ball nut 104.11 of the key sleeve subassembly 104 on the ball screw 105.6.1 can be determined using the Hall-effect sensors.

The electric motor 105.6.3 can generally be any type of electric motor which, (i) is compact enough to fit in the EMAP/A apparatus 2, (ii) is preferably reversible, (iii) can withstand the conditions downhole, and (iv) will provide sufficient rotational torque, either alone or in combination with the gearhead 105.6.2 to operate the inventive EMAP/A apparatus 100. Electrical power is preferably supplied to the electric motor by wire or cable from the surface, which is preferably incorporated in or extends through an e-coil tubular, but can alternatively be supplied by a battery, turbine, a downhole generator, or other electric power source.

A gearhead 105.6.2 is preferably used in conjunction with the electric motor 105.6.3 to make it possible to control a large load inertia with a comparatively small motor inertia, thus reducing the required size or power of the electric motor 105.6.3. Without the gearhead, the motor torque, and thus the current, would have to be as many times greater.

The actuator shoe 105.7 is made up on the lower end of the actuator housing 105.5. The actuator shoe 105.7 has an ID bore 105.71 at the upper end which houses electronics 116.0 used to control the actuator. An ID bore 105.72 at the lower end intersects two upward angled ports 105.7.3, 105.7.4 which are aligned with the angled ports in the lower mandrel 105.3. External threads 105.7.5 facing upwards allow makeup of the actuator shoe 105.7 to the housing 105.8; i.e., the lower end of the housing 105.8 is made up on the actuator shoe 105.7. The housing 105.8 extends upward over the lower end of the key sleeve subassembly 104. The upper end of the housing 105.8 is made up in the lower end of the shoe 105.9. The shoe 105.9 contains an internal seal 105.91 at the upper end and an external thread 105.92 at the lower end that makes up into the housing 105.8.

Additional components/features include the packer elements 106.0, packer element spacers 106.1, the slips 107.0, the retaining balls 108.1-108.4, the upper and lower spring retainers 109.1 and 109.2, the spring 110.0, a pressure equalizing piston 111.0, the flat (electric wireline) cable 112.0, hydraulic oil 113.0, a hydraulic oil fill plug 114.0, the cap screws 115.0, the electronics 116.0, and the fluid passage 117.0.

The packer elements 106.0 and packer element spacers 106.1 are assembled on the packer mandrel 105.2 and provide a seal between the casing ID 12 and packer mandrel 105.2 OD thereby providing the means for downhole zonal isolation.

The packer elements 106.0 can generally be any type of packer elements used in downhole tools. Examples of suitable packer elements include, but are not limited to various forms of nitrile rubber including carboxylated, hydrogenated nitrile butadiene rubber (NBR), fluoropolymers (e.g. Viton®), ethylene propylene diene monomers (EPDM) rubber etc. in assorted durometers (i.e. hardnesses) based on the downhole environment and other application-specific data. A typical 3-packer element system could consist of two higher durometer packer elements on the ends with a lower durometer (softer) packer element in the center, e.g. 90-70-90 durometer configurations are common. The packer elements 106.0 will preferably provide a pressure resistant seal, against the casing wall, which is capable of withstanding a pressure differential across the packer elements 106.0 of at least 5,000 or at least 10,000 or at least 20,000 psi, such that the packer elements 106.0 can withstand the magnitude of treating pressures encountered in high pressure hydraulic fracturing or other well stimulation, treating, or cementing operations.

The slips 107.0 are assembled on the slip wedge 102.2 and slip retainer 103.1 and expand out against the casing ID 12 when set to hold mechanical and hydraulic forces above the set packer elements 106.0. The retaining balls 108.1-108.4 are located in radial holes in the lower packer shoe 101 and slip wedge 102 subassemblies extending into external undercuts 105.2.3-105.25 on the packer mandrel 105.2. When covered by the ball retainer 104.2 internal upset 104.2.4, the retaining balls 108.1-108.4 lock the lower packer shoe 101.1 and slip wedge 102.2 subassemblies to the packer mandrel 105.2. When selectively uncovered by the ball retainer 104.2 internal upset 104.2.4, the retaining balls 108.1-108.4 unlock either or both of the lower packer shoe 101 and slip wedge 102 subassemblies to allow their movement.

The slips 107.0 used in the anchor apparatus can be any anchoring armatures or other slip structures used in downhole tools. The slips 107.0 will preferably be circumferentially spaced and collapsible and will engage the casing wall with a setting force of at least 5,000 or at least 7,500 or at least 10,000 lbs.

The spring retainers 109.1, 109.2 are located on the slip retainer subassembly 103, one contacting an external shoulder 103.3 at the upper end of the slip retainer 103.1 and one contacting the upper end of the spring compression nut 103.2. The spring 110.0 is located between the two spring retainers 109.1, 109.2 on the slip retainer subassembly 103.

The pressure equalizing piston 111.0 is inserted in the upper end of the key guide 105.4 and shoulders against the lower end of the lower mandrel 105.3. The pressure equalizing piston 111.0 has external seals 111.1 that seal against the key guide 105.4.

The flat (electric) cable 112.0 carries power and signals from the e-coil completely through the entire apparatus 100, thus providing electric power access to any tool string member below. In a preferred embodiment, each of the individual conductors of a multi-conductor electric cable are wrapped or spaced to accommodate an accompanying fiber optic cable. The flat cable 112.0 branches to the electronics 116.0 controlling the linear actuator sub-subassembly 105.6 and the linear actuator motor 105.6.3.

The hydraulic oil 103.0 is used to fill a closed volume containing the electro-mechanical actuator sub-subassembly 105.6 and is used for cooling the motor 105.6.3 and lubricating the gearhead 105.6.2, ball nut 104.11, and ball screw 105.6.1.

To run the e-coil deployed EMAP/A apparatus 100 into a wellbore, the apparatus 100 is put in the "running in" position. In the running in position, the ball nut 104.11 of key sleeve subassembly 104 is at the middle of the ball screw 105.6.1 of the actuator subassembly 105, which keeps the key sleeve subassembly 104 at a neutral position. In the neutral position, the key sleeve subassembly 104 keeps the lower set of retaining balls 108.2 in the lower packer shoe 101.1 subassembly and the upper and lower set of retaining balls 108.3, 108.4 in the slip wedge subassembly 102 pushed into external grooves on the actuator sub-subassembly 105, locking them in place preventing longitudinal movement. The upper set of retaining balls 108.1 in the packer shoe subassembly 101 are locked in place by the lower packer shoe 101.1 and prevent downward movement of the packer shoe subassembly 101.

The pre-compressed spring 110.0 is held in a neutral position between the two spring retainers 109.1, 109.2, each of which contacts both an internal shoulder in the key sleeve assembly 104 and an external shoulder on the slip retainer 103.1. Upward movement of the slip retainer subassembly 103 through the key sleeve subassembly which is for the moment retained in fixed position, is resisted by the initial pre-compression of the spring 110.0 and would only compress the spring 110.0 further. Downward movement of the slip retainer subassembly 103 is prevented by contact with the external upset 105.26 on the actuator sub-subassembly 105.

Also in the running in position, the packer elements 106.0 are held in an unset position and the slips 107.0 are held in a retracted position. The gearhead 105.6.3 on the linear actuator sub-subassembly 105.6 is self-locking so that upward or downward forces on the ball nut 104.11 cannot back drive the ball screw 105.6.1 and cause premature setting of the packer elements 106.0 and slips 107.0.

After the EMAP/A apparatus 100 is run to position in the well, a signal is sent to the electronics 116.0 through the wireline 112.0 to allow power to the actuator electric motor 105.6.3, causing the electric motor 105.6.3 to rotate the ball screw 105.6.1. Rotation of the ball screw 105.6.1 in turn moves the ball nut 104.11 and thus the key body 104.10 and the remainder of the key sleeve subassembly 104 upward. The key 104.9 transfers the movement and load from the key body 104.10 through the slots 105.10 in the key guide 105.4 to the key sleeve 104.8 and the rest of the key sleeve subassembly 104 components. The slots 105.41 in the key guide 105.4 prevent rotation of the key sleeve subassembly 104 by the ball screw 105.6.1.

As the key sleeve subassembly 104 moves upward, it exposes the retaining balls 108.2 in the lower packer shoe 101 and slip wedge 102 subassemblies to undercuts in the ball retainer 104.2, allowing the lower packer shoe 101 and slip wedge 102 subassemblies to move upward when loaded. The slips 107.0 are pushed up onto the slip wedge 102.2 and out against the casing 12 inner wall by the slip retainer 103 subassembly. The spring 110.0 remains in the neutral position at this point.

Continued upward movement of the key sleeve subassembly 104 causes additional compression of the spring 110.0 as the lower spring retainer 109.2 is moved upward by the key sleeve subassembly 104 and the upper spring retainer 109.1 is held stationary by the slip retainer subassembly 103. In addition, the key sleeve subassembly 104 contacts the external upset 102.11 at the upper end of the slip wedge subassembly 102.

Continued upward movement of the key sleeve subassembly 104 against the external upset 102.11 acts against the lower packer shoe sleeve 101.2 to begin loading and compressing the packer elements 106.0, expanding them outward against the casing 12 ID. The exposed retaining balls 108.2 are pushed upward and outward due to the angled shoulders of the grooves. The upper retaining balls in the lower packer shoe 101 and slip wedge 102 subassemblies remain locked and prevent downward movement but do allow upward movement. The slips 107.0 continue to move upward while expanded against the casing ID with no additional compression of the spring 110.0 as the packer elements 106.0 are compressed. Increased load on the actuator motor 105.6.3 reduces motor rotation, providing an indicator of the packer elements 106.0 setting.

Once the required setting force on the packer elements 106.0 is reached, power to the actuator motor 105.6.3 is shut off. The gearhead 105.6.2 is self-locking so the ball screw 105.6.1 will not back drive and reduce the setting force. The key sleeve subassembly 104 is pressure balanced to the internal pressure in the EMAP/A apparatus 100. Internal pressure will not increase or decrease the load on the electro-mechanical linear actuator sub-subassembly 105.6. The EMAP/A apparatus 100 holds pressure from above during fracking and from below when inverted in a straddle application. This pressure is applied to the set packer elements 106.0 and is transferred through the packer shoe 101 and slip wedge 102 subassemblies to the slips 107.0 and casing.

During setting operations, the volume between the upper end of the key sleeve subassembly 104 and the actuator sub-subassembly 104 decreases, causing fluid in this volume to be displaced to the OD of the EMAP/A apparatus 100. During unsetting operations, this volume increases, drawing in fluid.

The external seals at the upper and lower ends of the key body 104.1 straddle the slots 105.41 in the key guide 105.4, isolating the internal volume in the key guide 105.4, the actuator housing 1055, and actuator shoe 105.7. This allows hydraulic oil 103.0 to freely circulate in the closed volume when the key body 104.10 is moved up and down. As the key body moves up and down when setting and unsetting the packer elements 106.0 and slips 107.0, displaced hydraulic oil 103.0 below the key body 104.10 flows between the hall screw 105.6.1 OD and actuator housing 105.5 ID to the radial ports 105.6.12 at the lower end of the ball screw 105.6.1. Hydraulic oil 103.0 then flows through the radial ports 105.6.12 to the longitudinal hole 105.6.11 in the ball screw 105.6, out the upper end of the ball screw 105.6.1 and into the ID bore 104.104 at the lower end of the key body 104.10. Some hydraulic oil 103.0 can also pass between the ball nut 104.11 and ball screw 105.6.1, providing lubrication and cooling. The hydraulic oil 103.0 then passes through the longitudinal ports 104.105 in the key body 104.10 and into the volume 105.43 above the key body 104.10 and below the pressure equalizing piston 111.0.

The pressure equalizing piston 111.0 is located in the LD bore 105.43 of the key guide 105.4 above the key body 104.10. The upper side of the pressure equalizing piston 111.0 is exposed to pressure in the EMAP/A apparatus 100 and the lower side is exposed to pressure in the closed volume. This results in the two pressures always being equal.

The electric flat cable 112.0 is received in the apparatus 100 through the hollow cylindrical ID of the actuator subassembly 105. The cable 112.0 is run through the ID bore in the upper end of the actuator sub-subassembly 105, out one of the downward angled ports 105.35, 105.36, through one of the external longitudinal grooves on the key guide 105.4, over the OD of the actuator housing 105.5, and down the aligned upward angled port 105.73 and ID bore 105.72 in the actuator shoe 105.7. A part of the cable 112.0 is branched off above the downward angled port in the actuator shoe 105.7 to the electronics 116.0 in the upper ID bore 105.71 in the actuator shoe 105.7 to supply signals and power to the linear actuator sub-subassembly 105.6 components. The cable 112.0 then continues its path through and out of the EMAP/A apparatus 100, thus providing electric power (and in a preferred embodiment, fiber optic capacity) to any tool string member immediately below apparatus 100. A similar path located 180 degrees from the cable 112.0 path is used as a fluid passage, thus providing flow-through hydraulic capacity to any tool string member attached immediately below the inventive apparatus 100. Hence the apparatus 100 conducts electric, hydraulic, and fiber optic capacity throughout.

Pressure sensors can be located immediately above and below the apparatus 100 in the tool string, and connected fiber optically to the surface. Or similarly, pressure and/or temperature sensors 118.1 and 118.2 can be incorporated into apparatus 100 at positions above and below the packer elements 106.0, and connected fiber optically to the surface. Either alternative provides real-time pressure information at points above and below the packer elements 106.0, confirming both the establishment of a pressure seal upon setting the apparatus 100 in 'packer mode', and also maintenance of the integrity of the pressure seal throughout, for example, a hydraulic fracturing treatment placed above apparatus 100. Likewise, force sensors could be placed as to register real-time measurement of the force exerted by the slips 107.0 against the casing 12 inner wall when the apparatus 100 is in 'anchor mode'.

To unset apparatus 100, and specifically the components engaging the inner wall of casing 12, that is the packer elements 106.0 and slips 107.0, a signal is sent to the electronics 116.0 through the wireline cable 112.0 to allow power to the actuator electric motor 105.6.3 and reverse the rotation of the ball screw 105.6.1. This moves the ball nut 104.11 and key sleeve subassembly 104 downward, moving the upper and lower spring retainers 109.1, 109.2 respectively and spring 110.0 to the neutral position. Continued downward movement of the key sleeve subassembly 104 has it contacting the extended retaining balls 108.1,108.4 in the lower packer shoe 101 and slip wedge 102 subassemblies (specifically, at the ID of the ball retainer shoe 104.1 contacting retainer balls 108.2 in the lower packer shoe sleeve 101.2, and the internal upset 104.24 of ball retainer 104.2 contacting retainer balls 108.4 in slip wedge sleeve 102.1) and simultaneously moving the upper spring retainer 109.1 downward, which further compresses the spring 110.0 from above. Increased load on the actuator motor 105.6.3 reduces the motor rotation, providing an indicator of the contact with the extended retaining balls 108.1,108.4. Power to the actuator motor 105.6.3 is then shut off. At this point the apparatus 100 has been "unset" such that the packer elements 106.0 can no longer provide an effective seal, but the packer elements 106.0 are not fully retracted to their original run-in condition.

Full retraction of the packer elements 106.0 will then occur simply by moving the apparatus 100 to its next working location within wellbore casing 12. For example, in the case of an e-coil deployment of the inventive apparatus 100, simply "picking up" (i.e., applying sufficient tensile force for uphole movement) on the coiled tubing string will also move the actuator 105 and key sleeve 104 subassemblies upwards, releasing the packer elements 106.0 such that they can no longer provide an effective seal, also moving the spring retainers 109.1, 109.2 and spring 110.0 to the neutral position. Continued upward movement of the coiled tubing string, actuator 105 and key sleeve 104 subassemblies continues the retraction of the packer elements 106.0. The retaining balls 108.3 in the slip wedge subassembly 102 lock the slip wedge subassembly 102 to the actuator subassembly 105 against downward movement. The key sleeve subassembly 104 point of contact, the lower spring shoe 104.7, pushes the lower spring retainer 109.2 upward, further compressing the spring 110.0.

Power is again applied to the actuator motor 105.6.3, moving the key sleeve subassembly 104 down and moving the spring 110.0 to the neutral position. Continued downward movement of the key sleeve subassembly 104 to the neutral position over the retaining balls 108.2-108.4 locks the lower packer shoe 101 and slip wedge 102 subassemblies to the actuator subassembly 105. The key sleeve subassembly 104 (point of contact upper spring shoe 104.5) pushes the upper spring retainer 109.1 downward, further compressing the spring. The position of the key sleeve subassembly 104 is determined by the position of the ball nut 104.11 on the ball screw 105.6.1 using Hall-effect sensors. The coiled tubing string is picked up to move the actuator 105 and key sleeve 104 subassemblies upward, pulling the locked slip wedge subassembly 102, and particularly the slip wedge 102.2 out from beneath the slips 107.0. The spring 110.0 and slip retainer subassembly 103 then return to the neutral position, retracting the slips 107.0.

Similarly, the operation of the inventive (EMAP/A) apparatus 100 deployed in the "anchor only" option, i.e. packer elements 106.0 remain unset and only the slips 107.0 are engaged to anchor the run-in string, is enabled by reversing the direction of the electric motor 105.6.3 rotation as detailed here. In the running in position, the ball nut 104.11 is at the middle of the ball screw 105.6.1 which keeps the key sleeve subassembly 104 at a neutral position. In the neutral position, the key sleeve subassembly 104 keeps the lower set of retaining balls 108.2 in the lower packer shoe 101.1 subassembly and the upper and lower sets of retaining balls 108.3, 108.4 in the slip wedge 102.2 subassembly pushed into external grooves on the actuator sub-subassembly 105, locking them in place against longitudinal movement. The upper set of retaining balls 108.1 are locked in place by the lower packer shoe 101.1 and prevent downward movement of the packer shoe assembly subassembly. The pre-compressed spring 110.0 is held in a neutral position between the two spring retainers 109.1, 109.2, each of which contacts an internal shoulder in the key sleeve subassembly 104 and an external shoulder on the slip retainer subassembly 103. Upward movement of the slip retainer subassembly 103 is resisted by the initial pre-compression of the spring 110.0 and will only compress the spring 110.0 further. Downward movement of the slip retainer subassembly 103 is prevented by contact with an external upset 105.26 on the actuator subassembly 105. The packer elements 106.0 are held in an unset position and the slips 107.0 are held in a retracted position. The gearhead 105.6.2 on the linear actuator sub-subassembly 105.6 is self-locking so upward or downward forces on the ball nut 104.11 will not back drive the ball screw 105.6.1 and cause premature setting of the slips 107.0.

After the EMAP/A apparatus 100 is run to position in the well, a signal is sent to the electronics 116.0 through the wireline cable 112.0 to allow power to the actuator electric motor 105.6.3, causing the motor to rotate the ball screw 105.6.1. This in turn moves the ball nut 104.11 and key sleeve subassembly 104.8 downward. The key 104.9 transfers the movement and load from the key body 104.10 through the slots 105.10 in the key guide 105.4 to the key sleeve 104.8 and the rest of the key sleeve subassembly 104.8 components. The slots 105.10 in the key guide 105.4 prevent rotation of the key sleeve subassembly 104 by the ball screw 105.6.1. As the key sleeve subassembly 104 moves downward, it exposes the upper set of retaining balls 108.3 in the slip wedge subassembly 102 to undercuts in the ball retainer 104.2, allowing the slip wedge subassembly 102 to move downward when loaded. The lower retaining balls 108.2 in the lower packer shoe subassembly 101 remain locked and prevent upward movement but do allow downward movement. The key sleeve subassembly 104 contacts the upper spring retainer 109.1 and moves it downward, further compressing the spring 110.0. The key sleeve subassembly 104 then contacts the upper end of the slip wedge 102.2. Continued downward movement of the key sleeve subassembly 104 moves the slip wedge 102.2 beneath the slips 107.0, expanding them outward against the casing ID and against the slip retainer 103.1. The lower end of the slip retainer subassembly 103 is shouldered against an external upset 105.26 on the actuator sub-subassembly 105, preventing downward movement of the slip retainer 103.1. The uncovered lower retaining balls 108.4 in the slip wedge subassembly 102 move down and outward over the groove in the actuator sub-subassembly 105. The spring 110.0 is further compressed from above. Increased load on the actuator motor 105.6.3 reduces motor rotation, providing an indicator of the slips 107.0 setting. Once the required setting force on the slips 107.0 is reached, power to the linear actuator sub-subassembly 105.6 is shut off. The gearhead 105.6.2 is self-locking so the ball screw 105.6.1 will not back drive and reduce the setting force.

To unset the slips 107.0, a signal is sent to the electronics 116.0 through the wireline cable 112.0 to allow power to the actuator electric motor 105.6.3 and reverse the rotation of the ball screw 105.6.1. This moves the ball nut 104.11 and key sleeve subassembly 104 upward with the key sleeve subassembly 104 contacting the extended retaining balls 108.3, 108.4 in the slip wedge subassembly 102 and decreasing the spring 110.0 compression. An increase in load on the actuator motor 105.6.3 is an indicator of contact. Continued upward movement of the key sleeve subassembly 104 has it pulling the slip wedge 102.2 out from beneath the slips 107.0 through the extended retaining balls 108.3, 108.4 in the slip wedge subassembly 102 until the retracted retaining balls 108.3, 108.4 contact the upper end of the groove on the actuator subassembly 105 in which they are assembled. The compressed spring 110.0 keeps a downward force on the slips 107.0 as the slip wedge 102.0 moves upward, retracting the slips 107.0. The upper spring retainer 109.1 is also moved upward, further decreasing the spring 110.0 compression. A decrease in load on the actuator motor 105.6.3 is an indicator of the slip wedge 102.2 being pulled out from beneath the slips 107.0. Continued upward movement of the key sleeve subassembly 104 to the neutral position over the retaining balls 108.3, 108.4 locks the slip wedge subassembly 102 to the actuator subassembly 105. The spring 110.0 is in the neutral position. Actuator motor 105.6.3 rotations and Hall-effect sensors are used to indicate position.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within this invention as defined by the claims.

What is claimed is:

1. An apparatus for use in a wellbore comprising a packer and/or anchor assembly having:

a body having a longitudinally extending exterior;

a linear actuator subassembly in the body comprising an electric motor, a screw which is rotated by the electric motor, and a nut positioned on the screw which is locked against rotation and which moves linearly along the screw as the screw is rotated;

one or both of (a) a slip subassembly having a plurality of slips on the exterior of the body and/or (b) a packer subassembly having one or more packer elements on the exterior of the body; and a mechanical linkage subassembly which is connected to the nut and is moved longitudinally by the nut to (i) engage the slip subassembly to move the slips outwardly from the body to an anchoring position and/or (ii) engage the packer subassembly to transition the one or more packer elements to a sealing position.

2. The apparatus of claim 1 further comprising the linear actuator subassembly having a torque-amplifying gearhead connected between the electric motor and the screw.

3. The apparatus of claim 2 further comprising the electric motor and the gearhead providing reversible torque to repeatedly (a) set the slips in the anchoring position and/or set the one or more packer elements in the sealing position at one location in a well casing, (b) release the slips from the anchoring position to at least a partially withdrawn position and/or release the one or more packer elements from the sealing position to at least a partially withdrawn position sufficient to at least begin longitudinal movement of the packer and/or anchor assembly in the well casing, and (c) reset the slips in the anchoring position and/or reset the one or more packer elements in the sealing position at another location in the well casing.

4. The apparatus of claim 1 further comprising the packer and/or anchor assembly including the packer subassembly and the packer and/or anchor assembly further comprising real time pressure, temperature, and/or other sensors in the body above and below the one or more packer elements.

5. The apparatus of claim 1 further comprising an electric power source which powers the electric motor.

6. The apparatus of claim 5 further comprising the electric power source comprising an electric cable or other electric wireline, a battery, or a downhole generator.

7. The apparatus of claim 5 further comprising the electric power source comprising an electric cable or other electric wireline which extends through a passageway which runs longitudinally through the body.

8. The apparatus of claim 7 further comprising:

the body of the packer and/or anchor assembly being positioned on a tubing string or in a tool string connected to the tubing string and the electrical cable or other electric wireline extending through or being incorporated in the tubing string.

9. The apparatus of claim 8 comprising the tubing string being an e-coil tubular.

10. The apparatus of claim 8 comprising the electric cable or other electric wireline also including one or more fiber optic cables which receive and transmit data from the packer and/or anchor assembly and/or from one or more sensors located elsewhere in the tubing string or the tool string.

11. The apparatus of claim 1 further comprising the packer and/or anchor assembly having a fluid passageway which extends longitudinally through the body.

12. The apparatus of claim 1 further comprising:

the packer and/or anchor assembly comprising both the slip subassembly and the packer subassembly;

the nut being linearly movable on the screw in a first direction from a running-in location on the screw to a slip setting location in which the mechanical linkage subassembly engages the slip subassembly to move the slips outwardly from the body to the anchoring position; and the nut being linearly movable on the screw in the first direction from the slip setting location to a packer setting location in which the mechanical linkage subassembly engages the packer subassembly to transition the one or more packer elements to the sealing position.

13. The apparatus of claim 12 further comprising the nut being linearly movable on the screw in a second direction, opposite the first direction, from the running-in location on the screw to a slip only setting location in which the mechanical linkage subassembly engages the slip subassembly to move the slips outwardly from the body to the anchoring position without acting on the packer subassembly to transition the one or more packer elements to the sealing position.

14. The apparatus of claim 1 further comprising:

the packer and/or anchor assembly being a first packer and anchor assembly which includes both the slip subassembly and the packer subassembly;

the first packer and anchor assembly being positioned on a tubing string or in a tool string connected to the tubing string;

a second packer and anchor assembly positioned on the tubing string or in the tool string below the first packer and anchor assembly; and the second packer and anchor assembly comprising a body having a longitudinally extending exterior, a linear actuator subassembly, in the body of the second packer and anchor assembly, comprising an electric motor, a screw which is rotated by the electric motor of the second packer and anchor assembly, and a nut positioned on the screw of the second packer and anchor assembly which is locked against rotation and which moves linearly along the screw of the second packer and anchor assembly as the screw of the second packer and anchor assembly is rotated, a slip subassembly having a plurality of slips on the exterior of the body of the second packer and anchor assembly, a packer subassembly having one or more packer elements on the exterior of the body of the second packer and anchor assembly, and a mechanical linkage subassembly which is connected to the nut of the second packer and anchor assembly and is moved longitudinally by the nut of the second packer and anchor assembly to (i) engage the slip subassembly of the second packer and anchor assembly to move the slips of the second packer and anchor assembly outwardly from the body of the second packer and anchor assembly to an anchoring position and (ii) engage the packer subassembly of the second packer and anchor assembly to transition the one or more packer elements of the second packer and anchor assembly to a sealing position.

15. The apparatus of claim 14 further comprising an electrical cable or other electric wireline which extends through or is incorporated in the tubing string which provides electric power to the linear actuator subassembly of the first packer and anchor assembly and to the linear actuator subassembly of the second packer and anchor assembly.

16. The apparatus of claim 15 comprising the tubing string being an e-coil tubular.

17. The apparatus of claim 15 further comprising:

one of the first and the second packer and anchor assemblies being positioned on the tubing string or in the tool string with the packer subassembly of the one packer and anchor assembly being positioned above the slip subassembly of the one packer and anchor assembly and the other of the first and the second packer and anchor assemblies being positioned on the tubing string or in the tool string in an inverted position with the packer subassembly of the other packer and anchor assembly being positioned below the slip subassembly of the other packer and anchor assembly.

18. The apparatus of claim 14 further comprising the first and the second packer and anchor assemblies being independently operable for (a) setting the slips of one of the first and second packer and anchor assemblies in the anchoring position and/or setting the one or more packer elements of the one packer and anchor assembly in the sealing position both with and without (b) setting the slips of the other of the first and second packer and anchor assemblies in the anchoring position and/or setting the one or more packer elements of the other packer and anchor assembly in the sealing position.

19. The apparatus of claim 1 further comprising:

the packer and/or anchor assembly including both the packer subassembly and the slip subassembly and the packer subassembly and the slip subassembly being installed and positioned on the body such that, when the slips are in the anchoring position and the packer elements are in the sealing position, compressive forces acting on the packer elements are transmitted by the body to increase an outward anchoring force exerted by the slips.

20. A method of performing a downhole operation in a wellbore comprising the steps of:

(a) running a tubing string into the wellbore, the tubing string having an electric motor-actuated apparatus positioned on the tubing string or in a tool string connected to the tubing string, the electric motor-actuated apparatus comprising a body having a longitudinally extending exterior, a linear actuator subassembly in the body which includes and is driven by an electric motor, one or both of (i) a slip subassembly having a plurality of slips on the exterior of the body and/or (ii) a packer subassembly having one or more packer elements on the exterior of the body, and a mechanical linkage subassembly which is linked to the linear actuator subassembly; and (b) setting the slips and/or setting the one or more packer elements by activating the electric motor to move the mechanical linkage subassembly to (i) engage the slip subassembly to move the slips outwardly to an anchoring position in contact with an interior wall of a casing in the wellbore and/or (ii) engage the packer subassembly to transition the one or more packer elements to a sealing position in contact with the interior wall of the casing, the method further comprising the linear actuator subassembly also including an electronic unit for activating the electric motor, step (b) comprising sending a signal to the electronic unit to activate the electric motor, and supplying power to the electric motor and sending the signal to the electronic unit via an electric cable or other electric wireline which extends through or is incorporated in the tubing string.

21. The method of claim 20 comprising the tubing string being an e-coil tubular.

22. The method of claim 20 further comprising the step of transmitting real-time pressure and/or temperature signals from one or more sensors in the body of the electric motor-actuated apparatus through the electric cable or other electric wireline.

23. The method of claim 20 further comprising the step of transmitting data from the slip and/or packer subassemblies, and/or transmitting signals from one or more sensors in the body of the electric motor-actuated apparatus, via one or more fiber optic cables included in the electronic cable or other electric wireline.

24. The method of claim 20 further comprising:

the electric motor-actuated apparatus comprising both the slip subassembly and the packer subassembly and after step (b), pumping a fracturing fluid through an annulus formed between an exterior of the tubing string and the interior wall of the casing.

25. An apparatus for use in a wellbore comprising a packer and/or anchor assembly comprising:

a body having a longitudinally extending exterior;

a linear actuator subassembly in the body which includes and is driven by an electric motor;

one or both of (a) a slip subassembly having a plurality of slips on the exterior of the body and/or (b) a packer subassembly having one or more packer elements on the exterior of the body;

a mechanical linkage subassembly which is linked to the linear actuator subassembly and is moved longitudinally by the linear actuator subassembly to (i) engage the slip subassembly to move the slips outwardly from the body to an anchoring position and/or (ii) engage the packer subassembly to transition the one or more packer elements to a sealing position; and the electric motor being reversible to (a) set the slips in the anchoring position and/or set the one or more packer elements in the sealing position at one location in a well casing, (b) release the slips from the anchoring position to at least a partially withdrawn position and/or release the one or more packer elements from the sealing position to at least a partially withdrawn position sufficient to at least begin longitudinal movement of the packer and/or anchor assembly in the well casing, and (c) reset the slips in the anchoring position and/or reset the one or more packer elements in the sealing position at another location in the well casing.

26. The apparatus of claim 25 further comprising the packer and/or anchor assembly including the packer subassembly and the packer and/or anchor assembly further comprising real time pressure and/or temperature sensors in the body above and below the one or more packer elements.

27. The apparatus of claim 25 comprising an electric power source for the electric motor comprising an electric cable or other electric wireline, a battery, or a downhole generator.

28. The apparatus of claim 27 comprising:

the body of the packer and/or anchor assembly being positioned on a tubing string or in a tool string connected to the tubing string and the electric power source comprising an electric cable or other electric wireline which extends through or is incorporated in the tubing string.

29. The apparatus of claim 28 comprising the tubing string being an e-coil tubular.

30. A method of performing a downhole operation in a wellbore comprising the steps of:

(a) running a tubing string into the wellbore, the tubing string having an electric motor-actuated apparatus positioned on the tubing string or in a tool string connected to the tubing string, the electric motor-actuated apparatus comprising a body having a longitudinally extending exterior, a linear actuator subassembly in the body which includes and is driven by an electric motor, one or both of (i) a slip subassembly having a plurality of slips on the exterior of the body and/or (ii) a packer subassembly having one or more packer elements on the exterior of the body, and a mechanical linkage subassembly which is linked to the linear actuator subassembly;

(b) setting the slips and/or setting the one or more packer elements by activating the electric motor to move the mechanical linkage subassembly to (i) engage the slip subassembly to move the slips outwardly to an anchoring position in contact with an interior wall of a casing in the wellbore and/or (ii) engage the packer subassembly to transition the one or more packer elements to a sealing position in contact with the interior wall of the casing; and (c) after step (b), delivering a fluid through a passageway in the body of the electric motor-actuated apparatus.

31. A method of performing a downhole operation in a wellbore comprising the steps of:

(a) running a tubing string into the wellbore, the tubing string having an electric motor-actuated apparatus positioned on the tubing string or in a tool string connected to the tubing string, the electric motor-actuated apparatus comprising a body having a longitudinally extending exterior, a linear actuator subassembly in the body which includes and is driven by an electric motor, one or both of (i) a slip subassembly having a plurality of slips on the exterior of the body and/or (ii) a packer subassembly having one or more packer elements on the exterior of the body, and a mechanical linkage subassembly which is linked to the linear actuator subassembly;

(b) setting the slips and/or setting the one or more packer elements by activating the electric motor to move the mechanical linkage subassembly to (i) engage the slip subassembly to move the slips outwardly to an anchoring position in contact with an interior wall of a casing in the wellbore and/or (ii) engage the packer subassembly to transition the one or more packer elements to a sealing position in contact with the interior wall of the casing, the slips and/or the packer elements being set at a first location in the casing in step (b), the electric motor being activated in step (b) to rotate in a first direction, and the method further comprising the steps, after step (b) of activating the electric motor to rotate in a second direction, opposite the first direction which (i) releases the slips from the anchoring position to an at least partially withdrawn position and/or (ii) releases the one or more packer elements from the sealing position to an at least partially withdrawn position sufficient to at least begin longitudinal movement in the casing, moving the electric motor-actuated apparatus to a second location in the casing different from the first location, and then resetting the slips and/or resetting the packer elements by activating the electric motor to move the mechanical linkage subassembly to (i) engage the slip subassembly to move the slips outwardly to the anchoring position in contact with the interior wall of the casing in the wellbore and/or (ii) engage the packer subassembly to transition the one or more packer elements to the sealing position in contact with the interior wall of the casing.

32. A method of performing a downhole operation in a wellbore comprising the steps of:

(a) running a tubing string into the wellbore, the tubing string having an electric motor-actuated apparatus positioned on the tubing string or in a tool string connected to the tubing string, the electric motor-actuated apparatus comprising a body having a longitudinally extending exterior, a linear actuator subassembly in the body which includes and is driven by an electric motor, a slip subassembly having a plurality of slips on the exterior of the body, a packer subassembly having one or more packer elements on the exterior of the body, and a mechanical linkage subassembly which is linked to the linear actuator subassembly; and (b) setting the slips and setting the one or more packer elements by activating the electric motor to move the mechanical linkage subassembly to (i) engage the slip subassembly to move the slips outwardly to an anchoring position in contact with an interior wall of a casing in the wellbore and (ii) engage the packer subassembly to transition the one or more packer elements to a sealing position in contact with the interior wall of the casing, the linear actuator subassembly further comprising a screw which is rotated by the electric motor and a nut positioned on the screw which is locked against rotation and which moves linearly along the screw as the screw is rotated, the mechanical linkage subassembly being connected to the nut, and step (b) comprising activating the electric motor to move the nut linearly on the screw in a first direction to a slip setting location which acts through the mechanical linkage subassembly to engage the slip subassembly to move the slips outwardly to the anchoring position in contact with the interior wall of the casing in the wellbore and then move the nut further linearly on the screw in the first direction to a packer setting location which acts through the mechanical linkage subassembly to engage the packer subassembly to transition the one or more packer elements to the sealing position in contact with the interior wall of the casing.

33. A method of performing a downhole operation in a wellbore comprising the steps of:

(a) running a tubing string into the wellbore, the tubing string having an electric motor-actuated apparatus positioned on the tubing string or in a tool string connected to the tubing string, the electric motor-actuated apparatus comprising a body having a longitudinally extending exterior, a linear actuator subassembly in the body which includes and is driven by an electric motor, a slip subassembly having a plurality of slips on the exterior of the body, a packer subassembly having one or more packer elements on the exterior of the body, and a mechanical linkage subassembly which is linked to the linear actuator subassembly and (b) setting the slips, the linear actuator subassembly further comprising a screw which is rotated by the electric motor and a nut positioned on the screw which is locked against rotation and which moves linearly along the screw as the screw is rotated, the mechanical linkage subassembly being connected to the nut, and step (b) comprising activating the electric motor to move the nut linearly on the screw to a slip only setting location which acts through the mechanical linkage subassembly to engage the slip subassembly to move the slips outwardly to the anchoring position in contact with an interior wall of a casing in the wellbore without engaging the packer subassembly to transition the one or more packer elements to the sealing position.

34. A method of performing a downhole operation in a wellbore comprising the steps of:

(a) running a tubing string into the wellbore, the tubing string having a first electric motor-actuated apparatus positioned on the tubing string or in a tool string connected to the tubing string, the first electric motor-actuated apparatus comprising a body having a longitudinally extending exterior, a linear actuator subassembly in the body which includes and is driven by an electric motor, a slip subassembly having a plurality of slips on the exterior of the body, a packer subassembly having one or more packer elements on the exterior of the body, and a mechanical linkage subassembly which is linked to the linear actuator subassembly; and (b) setting the slips and setting the one or more packer elements by activating the electric motor to move the mechanical linkage subassembly to (i) engage the slip subassembly to move the slips outwardly to an anchoring position in contact with an interior wall of a casing in the wellbore and (ii) engage the packer subassembly to transition the one or more packer elements to a sealing position in contact with the interior wall of the casing, a second electric motor-actuated apparatus also being positioned on the tubing string, or in a tool string connected to the tubing string, below the first electric motor-actuated apparatus, the second electric motor-actuated apparatus comprising a body having a longitudinally extending exterior, a linear actuator subassembly, in the body of the second electric motor-actuated apparatus, which includes and is driven by an electric motor, a slip subassembly having a plurality of slips on the exterior of the body of the second electric motor-actuated apparatus, a packer subassembly having one or more packer elements on the exterior of the body of the second electric motor-actuated apparatus, and a mechanical linkage subassembly which is linked to the linear actuator subassembly of the second electric motor-actuated apparatus and is moved longitudinally by the linear actuator subassembly of the second electric motor-actuated apparatus; and the method further comprising the step, before, during, or after step (b), of (c) setting the slips and the one or more packer elements of the second electric motor-actuated apparatus by activating the electric motor of the second electric motor-actuated apparatus to move the mechanical linkage subassembly of the second electric motor-actuated apparatus to (i) engage the slip subassembly of the second electric motor-actuated apparatus to move the slips of the second electric motor-actuated apparatus outwardly to an anchoring position in contact with the interior wall of the casing and (ii) engage the packer subassembly of the second electric motor-actuated apparatus to transition the one or more packer elements of the second electric motor-actuated apparatus to a sealing position in contact with the interior wall of the casing, and steps (b) and (c) forming a sealed annular interval in the casing, outside of the bodies of the first and second electric motor-actuated apparatuses, which extends from the one or more packing elements of the first electric motor-actuated apparatus to the one or more packing elements of the second electric motor-actuated apparatus.

35. The method of claim 34 further comprising supplying power to the electric motors of the first and second electric motor-actuated apparatuses using an electrical cable or other electric wireline which extends through the body of the first electric motor-actuated apparatus.

36. The method of claim 34 further comprising delivering a fluid through the tubing string into the sealed annular interval via a fluid passageway in the body of the first electric motor-actuated apparatus.

37. The method of claim 34 further comprising:

the sealed annular interval being at a first location in the casing;

the method further comprising the steps, after steps (b) and (c), of activating the electric motors of the first and second electric motor-actuated apparatuses to (i) release the slips of the first and second electric motor-actuated apparatuses to an at least partially withdrawn position and (ii) release the one or more packer elements of the first and second electric motor-actuated apparatuses to an at least partially withdrawn position sufficient to at least begin longitudinal movement in the casing, moving the first and second electric motor-actuated apparatuses to a second location in the casing different from the first location, and then resetting the slips and resetting the one or more packer elements of the first and second electric motor-actuated apparatuses at the second location to form a sealed annular interval in the casing at the second location, outside of the bodies of the first and second electric motor-actuated apparatuses, which extends from the one or more packing elements of the first electric motor-actuated apparatus to the one or more packing elements of the second electric motor-actuated apparatus.

38. A method of performing a downhole operation in a wellbore comprising the steps of:

(a) running a tubing string into the wellbore, the tubing string having an electric motor-actuated apparatus positioned on the tubing string or in a tool string connected to the tubing string, the electric motor-actuated apparatus comprising a body having a longitudinally extending exterior, a linear actuator subassembly in the body which includes and is driven by an electric motor, a slip subassembly having a plurality of slips on the exterior of the body, a packer subassembly having one or more packer elements on the exterior of the body, and a mechanical linkage subassembly which is linked to the linear actuator subassembly;

(b) setting the slips and/or setting the one or more packer elements by activating the electric motor to move the mechanical linkage subassembly to (i) engage the slip subassembly to move the slips outwardly to an anchoring position in contact with an interior wall of a casing in the wellbore and/or (ii) engage the packer subassembly to transition the one or more packer elements to a sealing position in contact with the interior wall of the casing; and (c) after step (b), simultaneously (i) pumping a fracturing fluid through an annulus formed between an exterior of the tubing string and the interior wall of the casing and (ii) pumping a fracturing fluid through the tubing string.

39. The method of claim 38 comprising only the fracturing fluid pumped through the annulus having a proppant material therein.

40. An apparatus for use in a wellbore comprising:

first a packer and anchor assembly comprising:

a body having a longitudinally extending exterior;

a linear actuator subassembly in the body which includes and is driven by an electric motor;

a slip subassembly having a plurality of slips on the exterior of the body, a packer subassembly having one or more packer elements on the exterior of the body;

a mechanical linkage subassembly which is linked to the linear actuator subassembly and is moved longitudinally by the linear actuator subassembly to (i) engage the slip subassembly to move the slips outwardly from the body to an anchoring position and/or (ii) engage the packer subassembly to transition the one or more packer elements to a sealing position;

the first packer and anchor assembly being positioned on a tubing string or in a tool string connected to the tubing string;

a second packer and anchor assembly positioned on the tubing string or in the tool string below the first packer and anchor assembly, the second packer and anchor assembly comprising a body having a longitudinally extending exterior, a linear actuator subassembly, in the body of the second packer and anchor assembly, which includes and is driven by an electric motor, a slip subassembly having a plurality of slips on the exterior of the body of the second packer and anchor assembly, a packer subassembly having one or more packer elements on the exterior of the body of the second packer and anchor assembly, a mechanical linkage subassembly which is linked to the linear actuator subassembly of the second packer and anchor assembly and is moved longitudinally by the linear actuator subassembly of the second packer and anchor assembly to (i) engage the slip subassembly of the second packer and anchor assembly to move the slips of the second packer and anchor assembly outwardly from the body of the second packer and anchor assembly to an anchoring position and (ii) engage the packer subassembly of the second packer and anchor assembly to transition the one or more packer elements of the second packer and anchor assembly to a sealing position; and the tubing string comprising an e-coil tubular which provides electric power to the linear actuator subassembly of the first packer and anchor assembly and to the linear actuator subassembly of the second packer and anchor assembly.

41. The apparatus of claim 40 further comprising:

one of the first and the second packer and anchor assemblies being positioned on the tubing string or in the tool string with the packer subassembly of the one packer and anchor assembly being positioned above the slip subassembly of the one packer and anchor assembly and the other of the first and the second packer and anchor assemblies being positioned on the tubing string or in the tool string in an inverted position with the packer subassembly of the other packer and anchor assembly being positioned below the slip subassembly of the other packer and anchor assembly.

42. The apparatus of claim 40 further comprising the first and the second packer and anchor assemblies being independently operable for (a) setting the slips of one of the first and second packer and anchor assemblies in the anchoring position and/or setting the one or more packer elements of the one packer and anchor assembly in the sealing position both with and without (b) setting the slips of the other of the first and second packer and anchor assemblies in the anchoring position and/or setting the one or more packer elements of the other packer and anchor assembly in the sealing position.

* * * * *